US005680827A

United States Patent [19]

Sakanobe et al.

[11] Patent Number: 5,680,827

[45] Date of Patent: Oct. 28, 1997

[54] SEWING MACHINE HAVING LOWER-THREAD TENSION CHANGING DEVICE

[75] Inventors: Minoru Sakanobe, Komaki; Masao Ogawa, Nagoya, both of Japan

[73] Assignee: Brother Kogyo Kabushiki Kaisha, Aichi-ken, Japan

[21] Appl. No.: 497,889

[22] Filed: Jul. 3, 1995

[30] Foreign Application Priority Data

| | | | |
|---|---|---|---|
| Jul. 8, 1994 | [JP] | Japan | 6-156962 |
| Jul. 19, 1994 | [JP] | Japan | 6-166669 |
| Jun. 6, 1995 | [JP] | Japan | 7-139177 |

[51] Int. Cl.[6] ..... D05B 3/02; D05B 47/04

[52] U.S. Cl. ..... 112/443; 112/255

[58] Field of Search ..... 112/255, 254, 112/443, 459, 465, 466, 184, 229, 181, 458

[56] References Cited

U.S. PATENT DOCUMENTS

| | | | |
|---|---|---|---|
| 4,458,613 | 7/1984 | Eguchi et al. | 112/255 X |
| 4,700,644 | 10/1987 | Eguchi et al. | 112/255 |
| 4,938,158 | 7/1990 | Hanyu | 112/255 X |

FOREIGN PATENT DOCUMENTS

| | | |
|---|---|---|
| B2-61-3519 | 2/1986 | Japan . |
| B2-61-34360 | 8/1986 | Japan . |
| B2-63-6033 | 2/1988 | Japan . |
| A-63-270091 | 11/1988 | Japan . |
| B2-5-54359 | 8/1993 | Japan . |

*Primary Examiner*—Peter Nerbun

*Attorney, Agent, or Firm*—Oliff & Berridge

[57] ABSTRACT

A sewing machine includes a stitch forming device which forms stitches on a work sheet by locking an upper and a lower thread with each other, and a tension changing device which changes a tension of the lower thread to stop supplying of the lower thread to the stitch forming device at a predetermined timing. A sewing machine for forming stitches on a work sheet by locking an upper and a lower thread with each other, includes a pattern selecting device which selects one of a plurality of different stitch patterns, a detecting device which detects the selected one stitch pattern, and a tension changing device which changes, based on the detected one stitch pattern, a maximum tension of the lower thread to a corresponding one of a plurality of different tension values.

20 Claims, 11 Drawing Sheets

1

FIG.10B
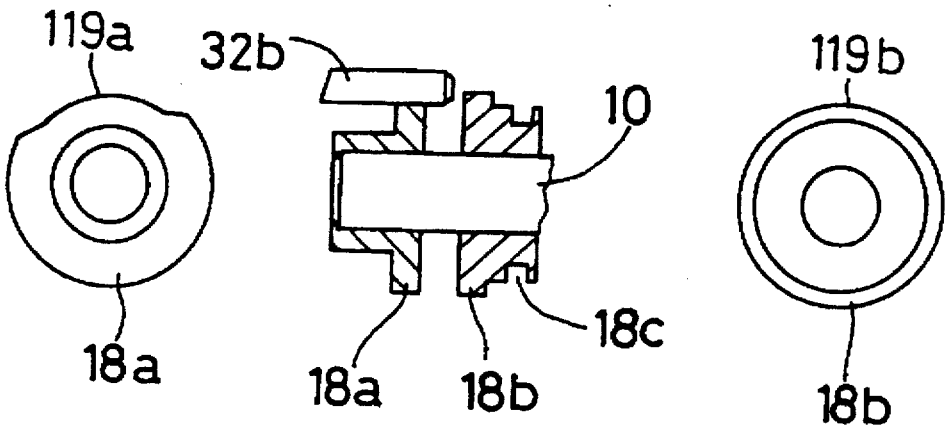
FIG.10A
FIG.10C
FIG.11B
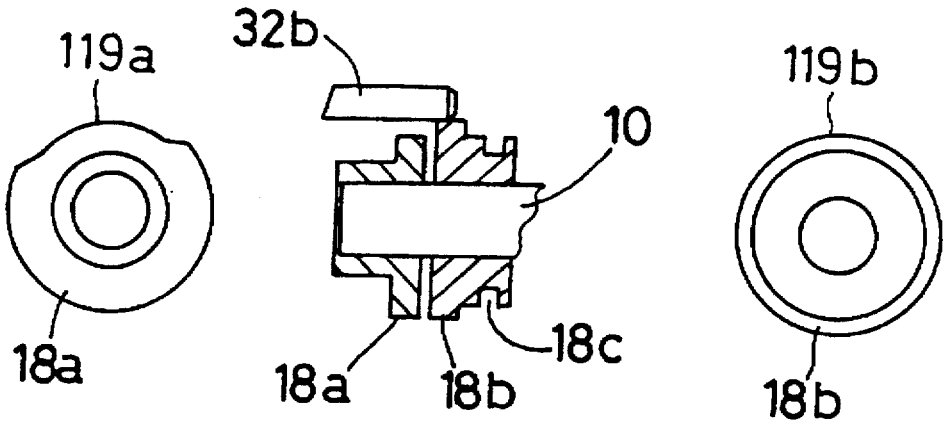
FIG.11A
FIG.11C

FIG.15B
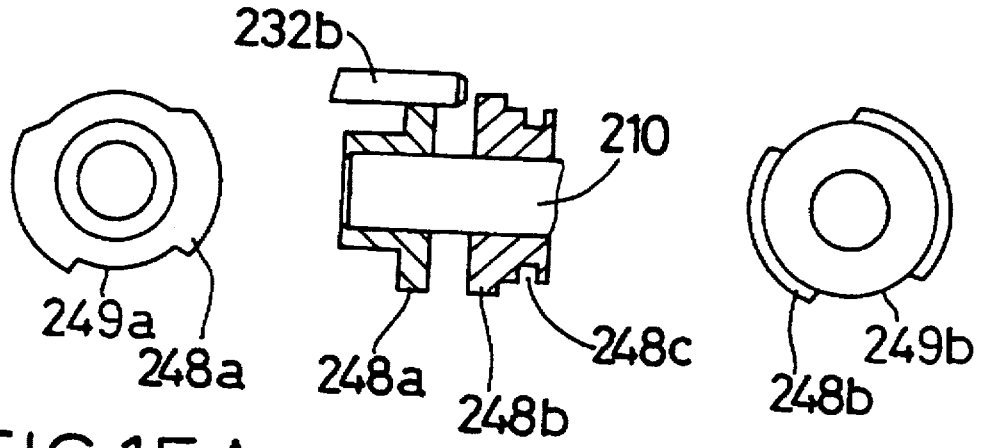
FIG.15A
FIG.15C
FIG.16B
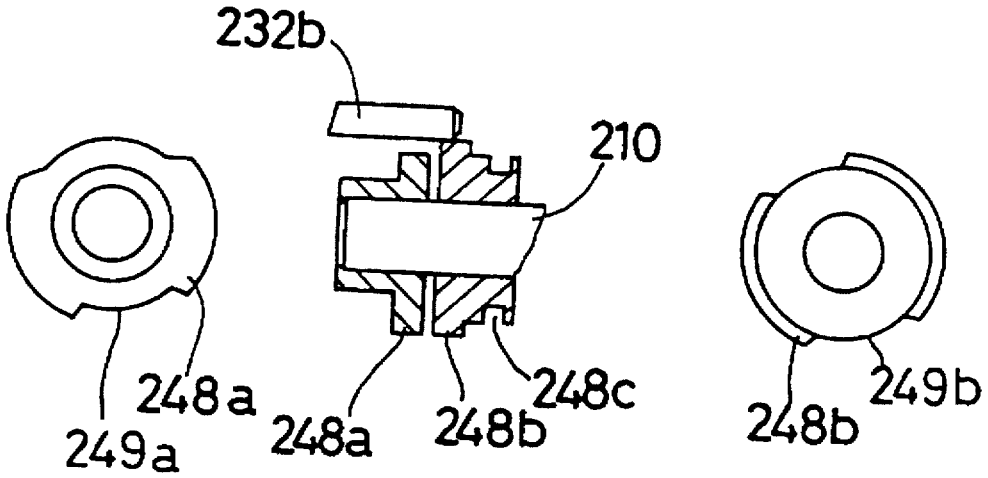
FIG.16A
FIG.16C

SEWING MACHINE HAVING LOWER-THREAD TENSION CHANGING DEVICE

BACKGROUND OF THE INVENTION

1. Field of the Invention

The present invention relates to a sewing machine which forms stitches by locking an upper and a lower thread with each other and particularly to such a sewing machine which can change a tension of the lower thread.

2. Related Art Statement

There is known a sewing machine in which a tension of an upper thread or an amount of supplying of the thread can be changed or controlled by a user based on sewing conditions such as thickness of a work sheet, thickness of the thread, and sewing speed, or a sewing machine which automatically changes or controls the upper-thread tension or supply amount based on detected sewing conditions. However, it is not sufficient to change or control the tension or supply amount of the upper thread only, in particular with respect to a thin work sheet.

In this background, Japanese Patent Application laid open for opposition under Publication No. 63(1988)-6033 discloses a sewing machine in which a maximum tension of a lower thread can be changed by a user's operable member provided outside a machine frame thereof. In this sewing machine, the lower-thread tension can be adjusted to balance with the upper-thread tension. The prior sewing machine has a pinching device for pinching the lower thread and applying a friction resistance to the thread when the thread is drawn therethrough. However, the pinching device cannot produce so great a resistance that stops or inhibits the drawing of the lower thread.

Japanese Patent Application laid open for opposition under Publication No. 61(1986)-3519 and unexamined Japanese Patent Application laid open under Publication No. 63(1988)-270091 discloses another sewing machine which provides appropriate lower-thread tension by controlling the amount of drawing of a lower thread each time a stitch is formed on a work sheet. In this sewing machine, the drawing of the lower thread is not stopped or inhibited.

In addition, Japanese Patent Application laid open for opposition under Publication No. 5(1993)-54359 discloses a sewing machine which obtains information relating to the amount of drawing of an upper thread and information relating to the angular phase of an upper or lower rotation shaft thereof. This sewing machine carries out calculation based on the obtained information and controls, based on the calculated results, the rotation of a bobbin around which a lower thread is wound, so that the tension of the lower thread is well balanced with the tension of the upper thread.

In the prior sewing machines disclosed in the above first to third Japanese patent documents, however, the tension of the lower thread is changed but the drawing of the thread is not inhibited. Accordingly, the tension of the lower thread ultimately depends on the balance of the respective tensions of the upper and lower threads. Thus, the lower-thread tension may vary as stitches are formed. When a great drawing force is exerted to the upper thread because of the occurrence of an unexpected accident to the sewing machine or the upper thread, the lower thread may be drawn by an unnecessarily large amount and the tension of the same may be ill balanced with the upper-thread tension.

The sewing machine shown in the fourth Japanese patent document needs a data processing device for processing information relating to the amount of drawing of the upper thread. This sewing machine additionally employs an upper-thread sensor and a driving device, resulting in increasing the production cost thereof. In addition, since the place where the amount of drawing of the upper thread is detected and the place where stitches are actually formed are distant from each other, the tension of the lower thread may not be controlled at an appropriate timing. Furthermore, a time delay resulting from the data processing may occur prior to the commencement of operation of the driving device, even in a short duration needed to form each stitch. Moreover, in the case where the sewing machine is operated at a high rotation speed, the lower thread is reeled off very fast, so that the bobbin may not effectively be controlled because the bobbin may be rotated due to inertia.

Japanese Patent Application laid open for opposition under Publication No. 61-34360 discloses a sewing machine which selects and reads information from an electronic storage device, based on a combination of a selected stitch pattern and a selected work-sheet thickness, and controls the tension of upper and/or lower threads. However, this sewing machine requires calculation or data processing to select the information corresponding to the specific combination. In addition, the sewing machine needs an exclusive driving device to control the respective tensions of the upper and lower threads. Thus, the sewing machine employs the electronic storage device, processing device such as a computer, and driving device that are not needed by other sewing machines. Thus, the production cost and overall size of the sewing machine inevitably increases.

SUMMARY OF THE INVENTION

It is therefore a first object of the present invention to provide a sewing machine which can control a lower thread with reliability and provide appropriate lower-thread tension with stability.

The first object has been achieved according to a first aspect of the present invention, which provides a sewing machine comprising: a stitch forming device which forms stitches on a work sheet by locking an upper and a lower thread with each other; and a tension changing device which changes a tension of the lower thread to stop supplying of the lower thread to the stitch forming device at a predetermined timing.

In the sewing machine constructed as described above, the tension changing device stops the supplying of the lower thread at a predetermined timing, even though an excessively great tension may be applied to the lower thread because of the occurrence of an unexpected accident to the upper thread or other causes when no more amount of the lower thread is needed. The present sewing machine effectively prevents the lower thread from unnecessarily being drawn, thereby preventing any trouble from the lower thread. Thus, the sewing machine provides appropriate lower-thread tension with stability. The sewing machine does not change the tension of the lower thread to a value variable depending upon an unstable, low friction resistance, but changes the tension of the lower thread to a value high enough to stop the supplying of the thread. Thus, the present sewing machine can form soft stitches and can form stitches on a thin work sheet. The sewing machine controls the lower thread with high reliability. When the tension changing device directly acts on the lower thread, the sewing machine can control the supply amount of the thread with higher accuracy.

In a preferred embodiment in accordance with the first aspect of the invention, the sewing machine further comprises a lower-thread storage device in which the lower thread is stored, the lower thread being supplied from the lower-thread storage device to the stitch forming device, the tension changing device stopping, at the predetermined timing, the supplying of the lower thread from the lower-thread storage device to the stitch forming device.

In another embodiment in accordance with the first aspect of the invention, the tension changing device comprises a pinching device which pinches the lower thread at a position intermediate in a lower-thread supply route from a lower-thread storage device to a throat plate having a needle throat. The pinching device may comprise a pair of pinching members, and the tension changing device may further comprise an actuator which moves one of the pair of pinching members relative to the other pinching member, between an operative position thereof in which the two pinching members cooperate with each other to pinch the lower thread to stop the supplying of the lower thread and an inoperative position thereof in which the two pinching members do not pinch the lower thread and permits the supplying of the lower thread. The other pinching member may comprise a bobbin case in which a bobbin is accommodated, the lower thread being stored in the bobbin case such that the lower thread is wound around the bobbin. The stitch forming device may comprise a sewing needle carrying the upper thread, a shuttle supplying the lower thread, and a driving device for driving the needle and the shuttle, and the actuator may be connected to the driving device so that the actuator actuates the one pinching member at a same period as a period at which the driving device operates for driving the needle and the shuttle. In the last case, the tension changing device does not need any processing device which processes information relating to the thickness of a work sheet and/or a lower thread, or any exclusive actuator such as a solenoid or a motor. Thus, the sewing machine is free from any delayed time between stitch formation and lower-thread control. Additionally, the sewing machine can be produced in a small size and at a low cost.

According to a preferred feature of the first aspect of the invention, the driving device comprises a driving motor, an upper rotary shaft connected to the driving motor and the needle, and a lower rotary shaft connected to the driving motor and the shuttle, the actuator comprising a cam member which is fixed to the lower rotary shaft and has a cam surface, a cam follower, and a biasing member for biasing the cam follower to contact and follow the cam surface of the cam member when the cam member is rotated with the lower rotary shaft, the one pinching member being fixed to the cam follower.

According to another feature of the first aspect of the invention, the cam surface of the cam member comprises at least one first surface portion to cause the one pinching member to move to the operative position thereof and at least one second surface portion to cause the one pinching member to move to the inoperative position thereof away from the operative position. Preferably, the cam surface has at least two first surface portions and at least two second surface portions.

In another embodiment in accordance with the first aspect of the invention, the sewing machine further comprises a sheet feeding device which intermittently feeds the work sheet as the stitch forming device forms the stitches on the work sheet by locking the upper and lower threads with each other, the tension changing device starting to stop the supplying of the lower thread at the predetermined timing when the sheet feeding device ends each intermittent feeding of the work sheet, and permitting the supplying of the lower thread while a loop of the upper thread is passed around a lower-thread storage device. In this case, the tension changing device stops the supplying of the lower thread at the predetermined timing other than when the upper-thread loop is passed around the lower-thread storage device. Therefore, the formation of stitches is not interfered with by the stopping of supplying of the lower thread. Thus, the present sewing machine prevents the occurrence of troubles of the lower thread during a predetermined time duration other than when the upper and lower threads are interlocked with each other to form each stitch on the work sheet.

In another embodiment in accordance with the first aspect of the invention, the sewing machine further comprises an upper-thread taking-up device which intermittently takes up the upper thread as the stitch forming device forms the stitches on the work sheet by locking the upper and lower threads with each other, the tension changing device starting to stop the supplying of the lower thread at the predetermined timing when the upper-thread taking-up device starts each intermittent taking-up of the upper thread, and permitting the supplying of the lower thread when the upper-thread taking-up device ends the each intermittent taking-up of the upper thread. In this case, for example, the drawing of a needed amount of the lower thread is permitted while the work sheet is fed. Thereafter, the supplying of the lower thread is stopped or inhibited and the lower thread is tightened. Thus, the tension of the lower thread is well balanced with the tension of the upper thread, so that neat stitches are formed with reliability. The tightening of the upper and lower threads is the most important in the formation of stitches. When the supplying of the lower thread is needed, for example, at the time of feeding of the work sheet, a very small force can smoothly draw the lower thread from a lower-thread storage device, so that no great force is exerted to the work sheet and no shrink of the sheet is observed. Therefore, neat stitches can be formed on even a thin work sheet.

In a preferred embodiment in accordance with the first aspect of the invention, the sewing machine further comprises a pattern selecting device which selects one of a plurality of different stitch patterns, the tension changing device stopping the supplying of the lower thread at the predetermined timing, when the pattern selecting device selects a first stitch pattern of the plurality of stitch patterns, and permitting the supplying of the lower thread at the predetermined timing, when the pattern selecting device selects a second stitch pattern of the different stitch patterns. In this case, the user has only to select a desired stitch pattern, and does not have to do anything else, to control the supply amount of the lower thread, at a value suitable for the selected stitch pattern. The control of the lower-thread supply amount is performed without being influenced by the tension of the upper thread.

According to a preferred feature of the first aspect of the invention, the second stitch pattern includes stitches formed by laterally swinging a sewing needle with respect to a direction of feeding of the work sheet, and the first stitch pattern consists of stitches which do not include any stitches formed by laterally swinging the needle. An amount of supplying of the lower thread needed to form each stitch of the first stitch pattern may be less than an amount of supplying of the lower thread needed to form each stitch of the second stitch pattern.

According to another feature of the first aspect of the invention, the sewing machine further comprises a detecting device which detects the one stitch pattern selected by the pattern selecting device, the tension changing device stopping and permitting the supplying of the lower thread based on the detected one stitch pattern.

It is a second object of the present invention to provide a sewing machine which changes a maximum tension of a lower thread to a value suitable for a stitch pattern selected by a user.

The second object has been achieved by a second and a third aspect of the present invention. According to the second aspect of the invention, there is provided a sewing machine for forming stitches on a work sheet by locking an upper and a lower thread with each other, comprising: a pattern selecting device which selects one of a plurality of different stitch patterns; a detecting device which detects the selected one stitch pattern; and a tension changing device which changes, based on the detected one stitch pattern, a maximum tension of the lower thread to a corresponding one of a plurality of different tension values.

In the sewing machine in accordance with the second aspect of the invention, a user is only required to select a desired stitch pattern and is not required to do any other operation, in order to change the maximum tension of the lower thread to a value suitable for the selected stitch pattern. Thus, the present sewing machine can provide appropriate lower-thread tension for each of various stitch patterns. The tension of the lower thread can be controlled with reliability and stability.

In a preferred embodiment in accordance with the second aspect of the invention, the detecting device is connected to the pattern selecting device so that the detecting device is moved, by the pattern selecting device, to one of a plurality of different positions of the detecting device which one position corresponds to the selected one stitch pattern, the tension changing device changing the maximum tension of the lower thread to one of the tension values which corresponds to the one position of the detecting device which represents the detected one stitch pattern. When the pattern selecting device is operated by the user for selecting a desired stitch pattern, the detecting device is moved to a position thereof corresponding to the selected stitch pattern. This sewing machine can be produced in a small size and at a low cost.

According to the third aspect of the invention, there is provided a sewing machine for forming stitches on a work sheet by locking an upper and a lower thread with each other, comprising: a pattern selecting device which is operable by a user for selecting one of a plurality of different stitch patterns, the pattern selecting device comprising a first movable member which is movable to one of a plurality of different positions thereof which corresponds to the selected one stitch pattern; a tension changing device which changes, based on the selected one stitch pattern, a maximum tension of the lower thread to a corresponding one of a plurality of different tension values, the tension changing device comprising a second movable member which is movable to one of a plurality of different positions thereof which corresponds to the selected one stitch pattern; and a connecting device which is connected to the first and second movable members of the pattern selecting device and the tension changing device to convert the motion of the first movable member to the one position thereof corresponding to the selected one stitch pattern, to the motion of the second member to the one position thereof corresponding to the selected one stitch pattern.

The sewing machine in accordance with the third aspect of the invention enjoys the same advantages as those with the sewing machine in accordance with the second aspect of the invention. In addition, the present sewing machine does not need any calculating device or actuator which operates based on information relating to the thickness of a selected work sheet and/or a selected stitch pattern. Thus, the sewing machine can be manufactured at a low cost, with a simple construction, and in a small size.

In a preferred embodiment in accordance with the third aspect of the invention, the tension changing device comprises at least one of a constant-tension applying device which applies a constant tension to the lower thread and a variable-tension applying device which applies a variable tension to the lower thread, the different tension values comprising at least one of the constant tension and the variable tension. The tension changing device may comprise both the constant-tension applying device and the variable-tension applying device, the variable-tension applying device applying the variable tension comprising a first tension value equal to zero and a second tension value greater than zero, the different tension values comprising the constant tension, and the constant tension plus the second tension value.

In another embodiment in accordance with the third aspect of the invention, the tension changing device comprises means for changing the maximum tension of the lower thread to a first tension value of the different tension values when the pattern selecting device selects a first stitch pattern of the different stitch patterns, and changing the maximum tension to a second tension value of the different tension values when the pattern selecting device selects a second stitch pattern of the different stitch patterns. The second stitch pattern may include stitches formed by laterally swinging a sewing needle with respect to a direction of feeding of the work sheet, and the first stitch pattern may consist of stitches which do not include any stitches formed by laterally swinging the needle, the first tension value being greater than the second tension value. The first stitch pattern may be straight stitch, and the second stitch pattern may be zigzag stitch. In the last case, the zigzag stitch is well sewn with a lower-thread tension lower than that for the straight stitch.

In another embodiment in accordance with the third aspect of the invention, the sewing machine further comprises a stitch forming device which forms the stitches on the work sheet by locking the upper and lower threads with each other, and the tension changing device changes the maximum tension of the lower thread to the first tension value to stop supplying of the lower thread to the stitch forming device at a predetermined timing when the first stitch pattern is selected, and changes the maximum tension to the second tension value to permit the supplying of the lower thread at the predetermined timing when the second stitch pattern is selected. In this case, the time duration in which the supplying of the lower thread is stopped or inhibited may be changed, and accordingly the amount of supplying of the lower thread may be changed, depending upon the selected stitch pattern.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which

FIG. 10 is a view of a first cam and a second cam positioned adjacent to the first cam, the two cams being a part of the lower-thread tension changing device of FIG. 6;

FIG. 11 is a view of the first cam and the second cam positioned away from the first cam;

FIG. 15 is a view of a first cam and a second cam positioned adjacent to the first cam, the two cams being a part of the lower-thread tension changing device of FIG. 13;

FIG. 16 is a view of the first cam and the second cam positioned away from the first cam.

DETAILED DESCRIPTION OF THE PREFERRED EMBODIMENTS

Figure 1:
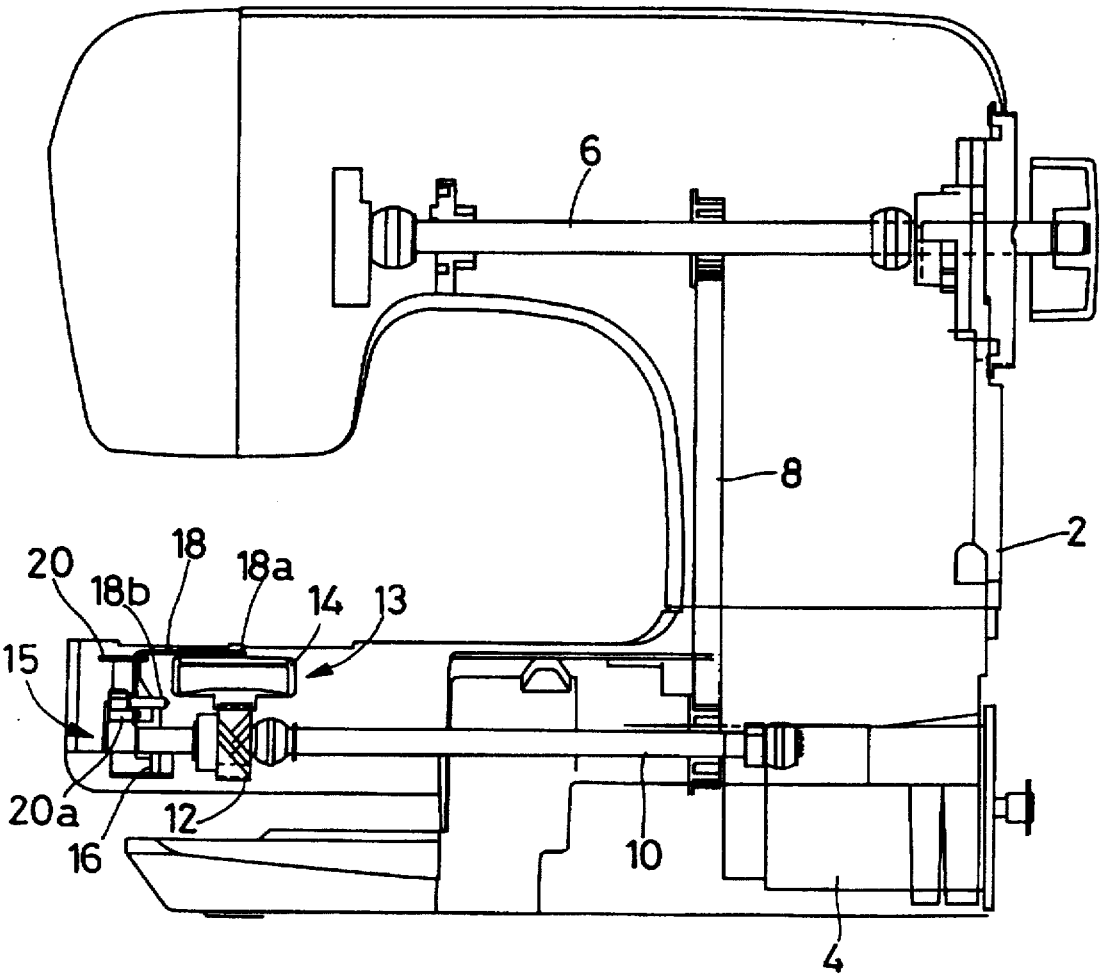
FIG. 1 is a cross-section view of a sewing machine embodying the present invention, the sewing machine having a lower-thread tension changing device.

Referring first to FIG. 1, there is shown a sewing machine 1 having a lower-thread tension changing device 15 for changing a tension of a lower thread 24 (FIG. 2), to which the present invention is applied.

The sewing machine 1 includes a machine frame 2 to which an electric motor 4 as a drive source is secured. An upper shaft 6, supported by the frame 2, is connected to the motor 4 and driven or rotated by the same 4. A lower shaft 10, also supported by the frame 2, is connected to the upper shaft 6 via a drive-force transmitting belt 8 and is driven or rotated at the same rotation speed as that of the upper shaft 6. A gear 12 is secured to the lower shaft 10 and is rotated together with the shaft 10. The gear 12 transmits the rotary motion of the lower shaft 10 to a rotating hook 14 of a shuttle 13. The rotating hook 14 is supported by the machine frame 2, and is rotated twice as fast as the lower shaft 10 so that the hook 14 smoothly catches an upper thread (not shown) and causes the upper thread to be locked with the lower thread 24 to form each stitch.

A cam 16 as a part of the lower-thread tension changing device 15 is fixed to a portion of the lower shaft 10 which portion is nearer to a free end of the shaft 10 than the gear 12. The cam 16 is rotated together with the lower shaft 10. The cam 16 has an outer circumferential surface or cam surface 17 which is engaged with, or followed by, a cam follower **18*b* as a part of a lower-thread stopping member 18. The stopping member 18 cooperates with a bobbin case 26 of the shuttle 13 to provide a pair of pinching members which pinch the lower thread 24 and stop supplying of the lower thread 24 to a stitch forming device provided by a sewing needle (not shown) connected to the upper shaft 6 and the rotating hook 14 connected to the lower shaft 10. The stopping member 18 is supported by a base member 20, fixed to the machine frame 2, such that the stopping member 18 is pivotable about an axis portion 20*a* of the base member 20**.

Figure 2:
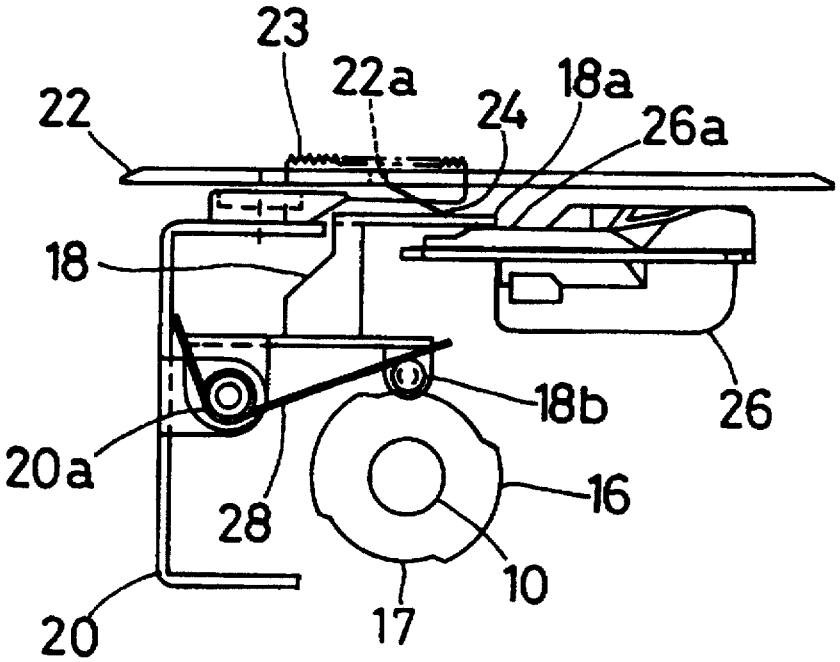
FIG. 2 is a side view of the lower-thread tension changing device of FIG. 1, showing a lower position thereof in which the changing device pinches and holds a lower thread.

As shown in FIG. 2, a work sheet such as a cloth or leather is fed, by a feed dog 23 as a sheet feeding device, on a throat plate 22 having a needle throat or hole **22*a* through which the lower thread 24 is passed with being locked with the upper thread carried by the needle. The throat plate 22 is movable relative to the machine frame 2**.

The bobbin case 26 is accommodated in the rotating hook 14. A lower-thread holding portion **18*a* of the stopping member 18 cooperates with a top surface 26*a* of the bobbin case 26 to pinch and hold the lower thread 24 such that the supplying of the lower thread 24 to the stitch forming device is inhibited. That is, the maximum tension of the lower thread 24 is changed or increased to such an extent that no amount of the lower thread 24 can be drawn. A spring 28 biases the cam follower 18*b* of the lower-thread stopping member 18 to contact and follow the cam surface 17 of the cam 16, and simultaneously biases the lower-thread holding portion 18*a* toward the top surface 26*a* of the bobbin case 26**.

Figure 3:
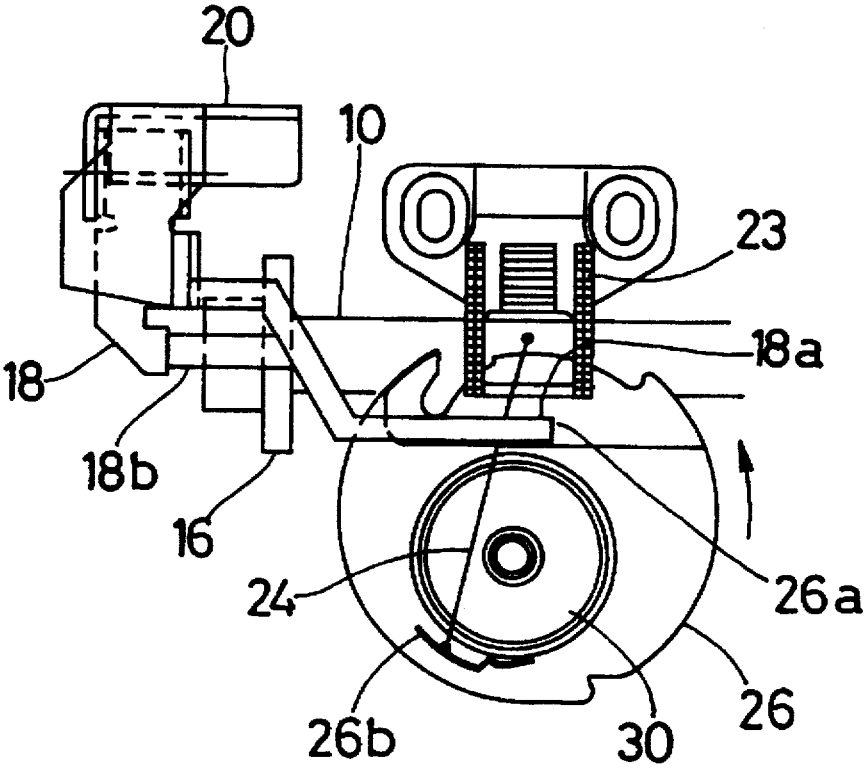
FIG. 3 is a plan view of the lower-thread tension changing device of FIG. 1.

As shown in FIG. 3, a bobbin 30 is accommodated in the bobbin case 26. The bobbin 30 is a lower-thread storage device in which the lower thread 24 is stored. The lower thread 24 is supplied from the bobbin 30 to the stitch forming device provided by the sewing needle and the rotating hook 14. A bobbin-case spring **26*b* engages the lower thread 24 just after the thread 24 comes out of the bobbin case 26. When the lower thread 24 is passed between the spring 26*b* and the bobbin case 26, the thread 24 is subjected to a frictional resistance which results in producing a tension in the thread 24. In the present embodiment, however, this tension is very low and just contributes to removing twisting of the thread 24 and therefore can be regarded as applying substantially no resistance to the passing of the thread 24. The lower thread 24 is subsequently fed to the needle throat 22*a* of the throat plate 22 and cooperates with the upper thread to produce stitches on the work sheet being carried on the plate 22. The lower-thread holding portion 18a of the lower-thread stopping member 18 and the top surface 26a of the bobbin case 26 cooperate with each other to pinch and hold the lower thread 24 and stop the supplying of the thread 24 to the stitch forming device, at a position intermediate in a lower-thread supplying route from the bobbin 30 to the throat plate 22**.

Next, there will be described in detail the operation of the sewing machine 1 constructed as described above.

Figure 4:
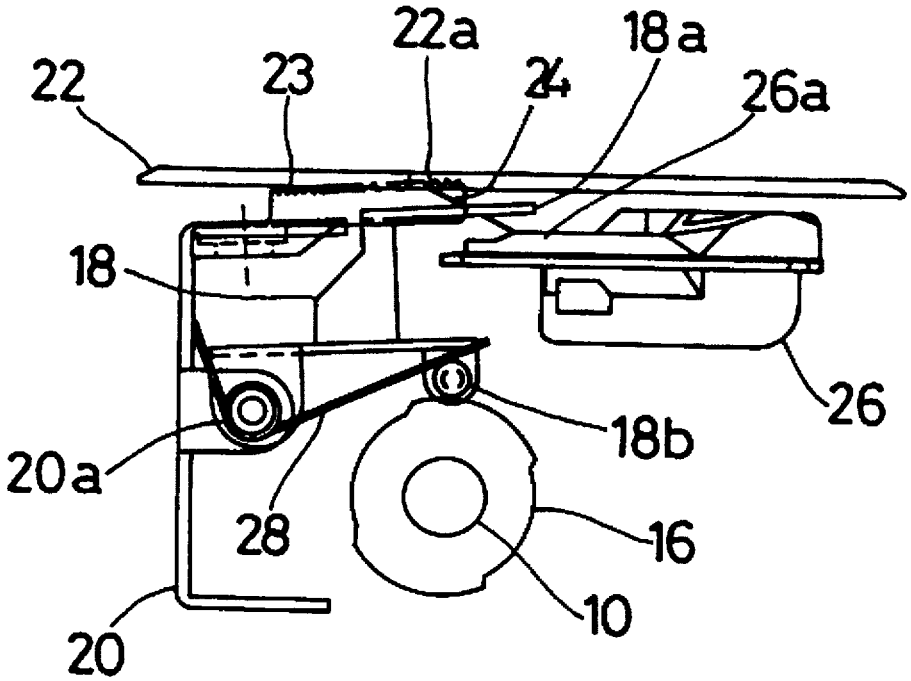
FIG. 4 is a side view of the lower-thread tension changing device of FIG. 1, showing an upper position thereof in which the changing device releases the lower thread.

As shown in FIGS. 2 and 4, when the sewing machine 1 is operated, i.e., when the lower shaft 10 is rotated by the motor 4, the cam 16 fixed to the shaft 10 is also rotated. Each stitch is formed on the work sheet while the lower shaft 10 is rotated one time, i.e., 360 degrees. Since the cam 16 is rotated together with the lower shaft 10, each stitch is formed in one rotation cycle of the cam 16. Since the cam follower 18b of the lower-thread stopping member 18 contacts and follows the cam surface 17 of the cam member 16, the stopping member 18 swings according to the shape of the cam surface 17, so that the lower-thread holding portion 18a of the stopping member 18 cyclically moves up and down and the position of the holding portion 18a relative to the top surface 26a of the bobbin case 26 cyclically changes. In FIG. 2, since the cam follower 18b contacts a bottom portion of the cam surface 17, the holding portion 18a is pressed downward on the bobbin-case top surface 26a by the biasing spring 28 so that the two portions 18a, 26a cooperate with each other to pinch and hold the lower thread 24 and stop the supplying of the thread 24 to the stitch forming device or the work sheet.

On the other hand, in FIG. 4, since the cam follower 18b contacts a top portion of the cam surface 17, the holding portion 18a is kept away from the bobbin-case top surface 26a against the biasing spring 28 so that the two portions 18a, 26a release the lower thread 24 and permit the drawing of the thread 24 from the bobbin 30 to the work sheet.

Figure 5:
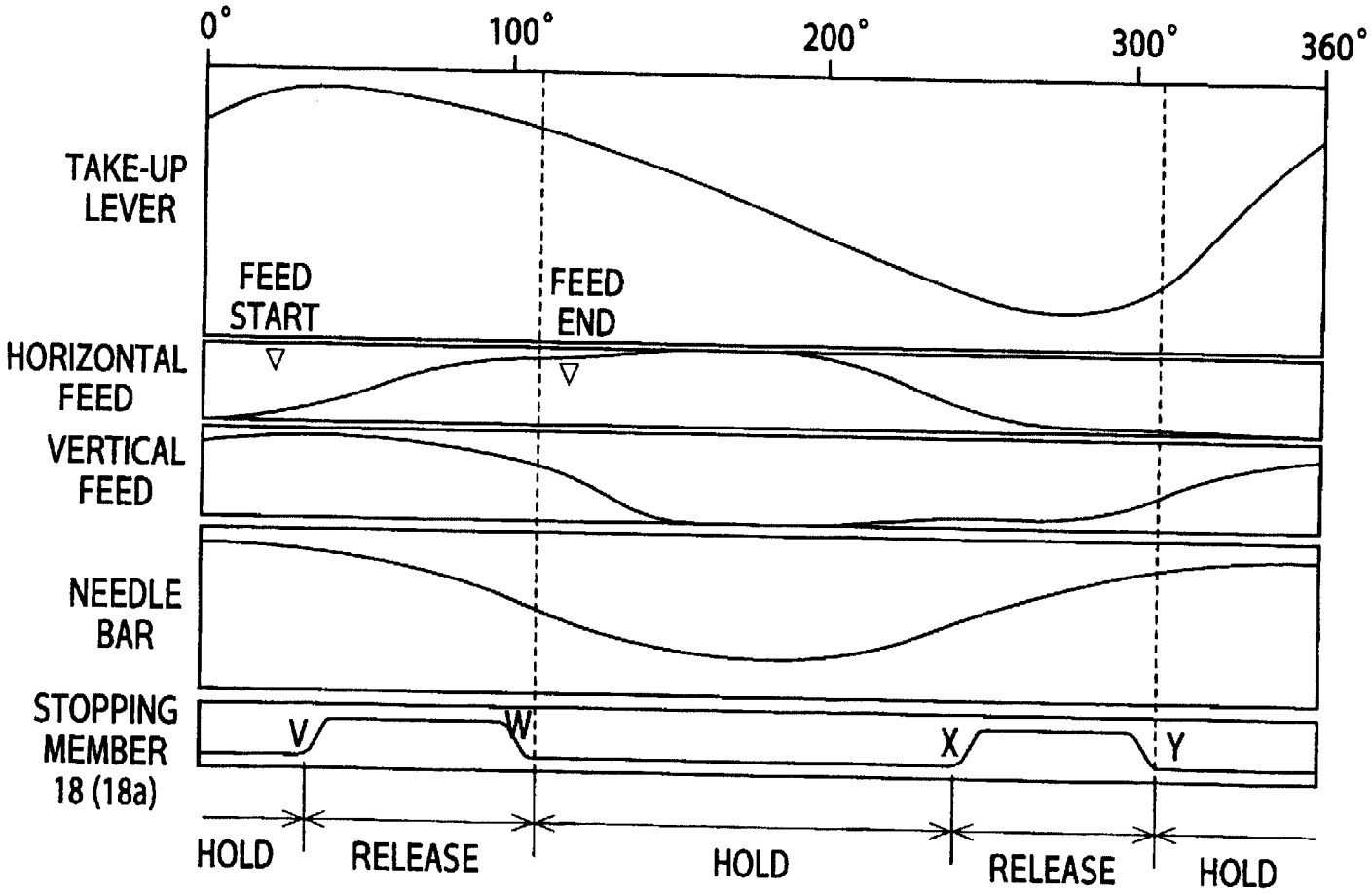
FIG. 5 is a timing chart showing the movements of various elements of the sewing machine of FIG. 1 during one revolution (i.e., 360 degrees rotation) of an upper (or lower) shaft of the same.

FIG. 5 shows a timing chart having an axis of abscissa indicative of an rotation angle, θ (θ=0 to 360 degrees), of the upper shaft 6 or lower shaft 10. The angle, θ=0 degree, corresponds to an upper dead position of a needle bar (not shown) to the lower end of which the sewing needle is secured; the angle, θ=180 degrees, corresponds to a lower dead position of the needle bar; and the angle, θ=360 degrees, is back again to the upper dead position of the needle bar so that each stitch is formed on the work sheet. The timing chart has five axes of ordinate the first one of which is indicative of an amount of vertical movement of an upper-thread take-up lever (not shown) of the sewing machine 1, the second of which is indicative of an amount of horizontal movement of the feed dog 23, the third of which is indicative of an amount of vertical movement of the feed dog 23, the fourth of which is indicative of an amount of vertical movement of the needle bar, and the fifth of which is indicative of an amount of vertical movement of the lower-thread holding portion 18a of the stopping member 18.

At the angle θ=0 degree, the needle bar starts to move downward from the upper dead position thereof. At that time, the upper-thread take-up lever is moving upward to tighten the upper thread, and subsequently the feed dog 23 starts to feed the work sheet. In that situation, the holding portion 18a is held in a lower position thereof where the holding portion 18a contacts the bobbin-case top surface 26a to pinch and hold the lower thread 24 and inhibit the drawing of the thread 24 from the bobbin 30. Each stitch is formed in the work sheet in such a manner that the lower thread 24 is tightened simultaneously with the tightening of the upper thread. Thus, the loosening of the lower thread 24 as well as the upper thread is effectively prevented.

After the tightening of the threads is completed, the lower shaft 10 is further rotated so that the cam follower 18b of the lower-thread stopping member 18 contacts a top portion of the cam surface 17 of the cam 16. Consequently the holding portion 18a starts to move upward, at a point, V (FIG. 5), to an upper position thereof where the holding portion 18a is away from the bobbin-case top surface 26a, releases the lower thread 24, and permits the the thread 24 to be drawn from the bobbin 30 for the feeding of the work sheet by the feed dog 23. When the lower shaft 10 is further rotated and each feeding of the work sheet for the formation of each stitch is completed, the cam follower 18b starts to contact another bottom portion of the cam surface 17, so that the holding portion 18a moves downward, at a point, W, to the lower position thereof where the holding portion 18a pinches the lower thread 24. Since the lower thread 24 is immovably held by the holding portion 18a and the top surface 26a, no unnecessary amount of the thread 24 is drawn from the bobbin 30. Thus, the present sewing machine 1 is free from a conventionally experienced problem that unnecessary amounts of the lower thread 24 are supplied and the quality of stitches is lowered. Around the point W, the sewing needle reaches the work sheet on the throat plate 22.

When the upper shaft 6 is further rotated, the needle bar reaches the lower dead position thereof and then starts to move upward, so that the upper thread carried by the needle makes a loop which in turn is caught by a point-of-hook of the rotating hook 14 and is passed around the bobbin case 26. If in this situation the holding portion 18a is held at the lower position thereof in which the holding portion 18a contacts the bobbin-case top surface 26a, the loop of the upper thread cannot be passed around the bobbin case 26. Therefore, when the upper-thread loop is passed around the bobbin case 26, the cam follower 18b is temporarily engaged with another top portion of the cam surface 17 of the cam 16, so that the holding portion 18a moves upward, at a point, X, to the upper position thereof. Thus, the upper thread can be locked with the lower thread 24. After the upper thread is passed around the bobbin case 26, the cam follower 18b again engages the first bottom portion of the cam surface 17, so that the holding portion 18a moves downward, at a point, Y, to the lower position thereof to pinch the lower thread 24. The upper and lower shafts 6, 10 are further rotated, and one rotation cycle of the cam 16 is completed. Thus, each stitch is formed in the work sheet.

In the first embodiment shown in FIGS. 1 to 5, the point V where the cam follower 18b moves from the first bottom portion, to the first top portion, of the cam surface 17 of the cam 16 is pre-determined at the timing when the feeding of the work sheet is started by the feed dog 23. However, the point V may be pre-determined at a different timing, depending on the performance of a sewing machine to which the present invention is applied, for example, depending on the test results using the sewing machine. Similarly, although the point W where the cam follower 18b moves from the first top portion, to the second bottom portion, of the cam surface 17 is pre-determined at the timing when the feeding of the work sheet is ended, the point W may be pre-determined at a different timing, depending on the performance of each sewing machine, for example, depending on the test results using the sewing machine.

In the present sewing machine 1 having the lower-thread tension changing device 15, the maximum tension of the lower thread 24 is not controlled depending on an unstable friction resistance, but is increased by pinching and holding to such a value to cause stopping of the supplying thereof to the work sheet. Thus, the amount of supplying of the lower thread 24 can be controlled with accuracy. Since no intervening member such as an actuator which operates in response to a detection signal is employed for controlling the supply amount of the lower thread 24, that is, since the holding portion 18a directly holds and releases the lower thread 24, the supply amount of the thread 24 can be controlled accurately and quickly.

The supplying of the lower thread 24 is permitted when the work sheet is fed, or when the upper thread is locked with the lower thread 24. In those situations, the lower thread 24 can smoothly be drawn with a very small force, so that no great force is applied to the work sheet and no shrink of the sheet results. Even with a thin work sheet, stitches are formed with high quality. Even in the case where a great tension is produced in the upper thread because of the occurrence of an expected accident to the upper thread or other causes though the supplying of the lower thread 24 is not needed, the present sewing machine 1 effectively prevents the thread 24 from unnecessarily being drawn from the bobbin 30, thereby preventing any trouble of the thread 24 such as being entangled, or being caught by other elements of the sewing machine 1. The tightening of the threads is the most important in the formation of stitches. In the present embodiment, the tightening of the lower thread 24 is done after a needed amount of the lower thread 24 is supplied during the feeding of the work sheet and then the drawing of a further amount of the thread 24 is inhibited. Thus, neat stitches are formed with reliability.

The lower-thread tension changing device 15 does not require any calculation or data processing and therefore does not employ any calculating or data processing device such as a computer, or any actuator or sensor. Thus, the present sewing machine 1 can be produced in a small size and at a low cost. The tension changing device 15 does not need any time for calculation or data processing, and is free from any time loss between the production of a command to start the operation of an actuator or a sensor and the actual starting of operation, or any delayed time from the detection of a sensor at a position away from the place where stitches are actually formed on the work sheet, to the operation of an actuator in response to the detection of the sensor. The present sewing machine 1 can form uniform and neat stitches from the first stitch to the last of any stitch pattern.

Figure 6:
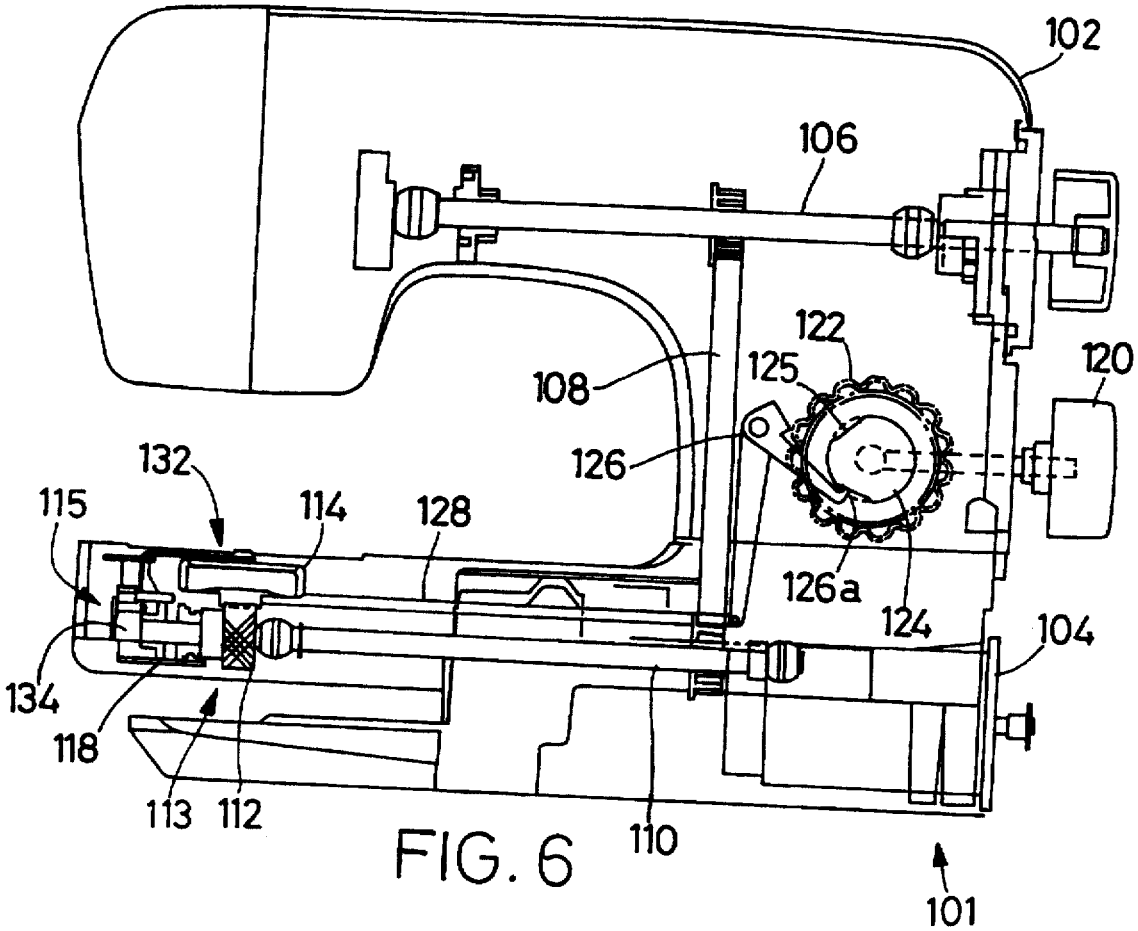
FIG. 6 is a view corresponding to FIG. 1, showing another sewing machine as a second embodiment of the present invention, the sewing machine having a lower-thread tension changing device.

Referring next to FIG. 6, there is shown a second embodiment of the present invention. The second embodiment relates to a sewing machine 101 having a lower-thread tension changing device 115 which changes a maximum tension of a lower thread 116 (FIG. 2) by applying a frictional resistance to the thread 116.

The sewing machine 101 includes a machine frame 102 to which an electric motor 104 as a drive source is secured. An upper shaft 106, supported by the frame 102, is connected to the motor 104 and is driven or rotated by the same 104. A lower shaft 110, also supported by the frame 102, is connected to the upper shaft 106 via a drive-force transmitting belt 108 and is driven or rotated at the same rotation speed as that of the upper shaft 106. A gear 112 is secured to the lower shaft 110 and is rotated together with the shaft 110. The gear 112 transmits the rotary motion of the lower shaft 110 to a rotating hook 114 of a shuttle 113. The rotating hook 114 is supported by the machine frame 102, and is rotated twice as fast as the lower shaft 110 so that the hook 114 smoothly catches an upper thread (not shown) and causes the upper thread to be locked with the lower thread 116 to form each stitch on a work sheet.

A cam device 118 as a part of the lower-thread tension changing device 115 is secured to a portion of the lower shaft 110 which portion is nearer to a free end of the shaft 110 than the gear 112. The cam device 118 is rotated together with the lower shaft 110. The cam device 118 includes a first and a second cam 118*a*, 118*b* which have a first and a second cam surface 119*a*, 119*b* (FIGS. 10 and 11), respectively. The first cam 118*a* corresponds to one or more straight stitch patterns, and the first and second cams 118*a*, 118*b* correspond to one or more needle-swing stitch patterns. Each of the stitch patterns is selectable by a pattern selecting handle 120. The second cam 118*b* is movable relative to the first cam 118*a* on the lower shaft 110 in an axial direction of the shaft 110. A biasing device such as a spring (not shown) causes the second cam 118*b* to be located at a predetermined position away from the first cam 118*a*. The two cams 118*a*, 118*b* are rotated together with the lower shaft 110.

The pattern selecting handle 120 is rotatably supported by the machine frame 102. The handle 120 is rotated by a user for selecting a desired one of stitch patterns from outside the frame 102. When the handle 120 is rotated by the user, a pattern selecting cam 122 is correspondingly rotated so that the sewing machine 101 recognizes or specifies the stitch pattern selected by the user. Each stitch pattern is characterized by a specific sheet-feeding pattern and/or a specific needle-swinging pattern. The handle 120 and the cam 122 cooperate with each other to provide a pattern selecting device of the sewing machine 101.

Figure 7:
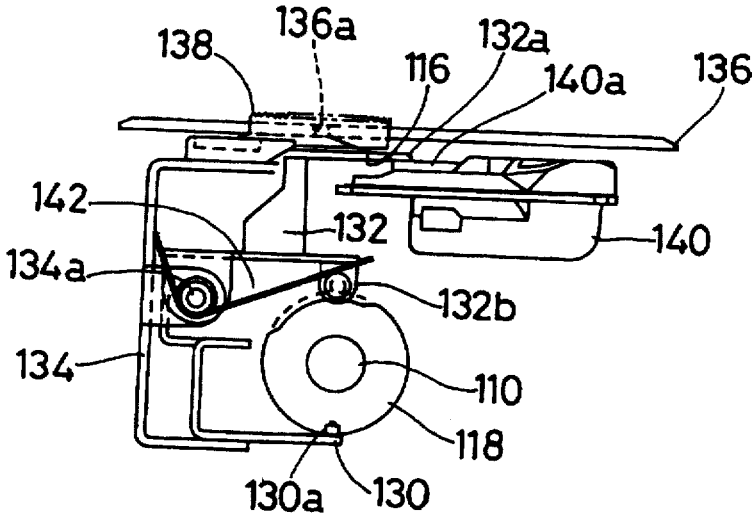
FIG. 7 is a view corresponding to FIG. 2, showing the lower-thread tension changing device of FIG. 6 which is held at a lower position thereof in which the changing device pinches a lower thread and thereby applies a higher tension to the thread.

A selected-pattern detecting cam 124 is fixed to the pattern selecting cam 122. A switching lever 126 is pivotally supported by the machine frame 102, and includes a cam follower 126*a* which is biased by a biasing device such as a spring (not shown) to contact and follow a cam surface 125 of the pattern detecting cam 124. The cam surface 125 has two top or higher surface portions corresponding to one or more straight stitch patterns each consisting of stitches which do not include any stitches formed by swinging a sewing needle (not shown) of the sewing machine 101. The cam surface 125 also has two bottom or lower surface portions corresponding to one or more needle-swing stitch patterns each including stitches formed by swinging the needle. Therefore, when a needle-swing stitch pattern is selected by the user, the cam follower 126*a* of the switching lever 126 contacts a bottom portion of the cam surface 125 of the pattern detecting cam 124. This motion of the lever 126 is transmitted to the second cam 118*b* via a connecting rod 128 and a cam moving member 130 (FIG. 7). The pattern detecting cam 124 and the switching lever 126 cooperate with each other to provide a pattern detecting device of the sewing machine 101.

Figure 8:
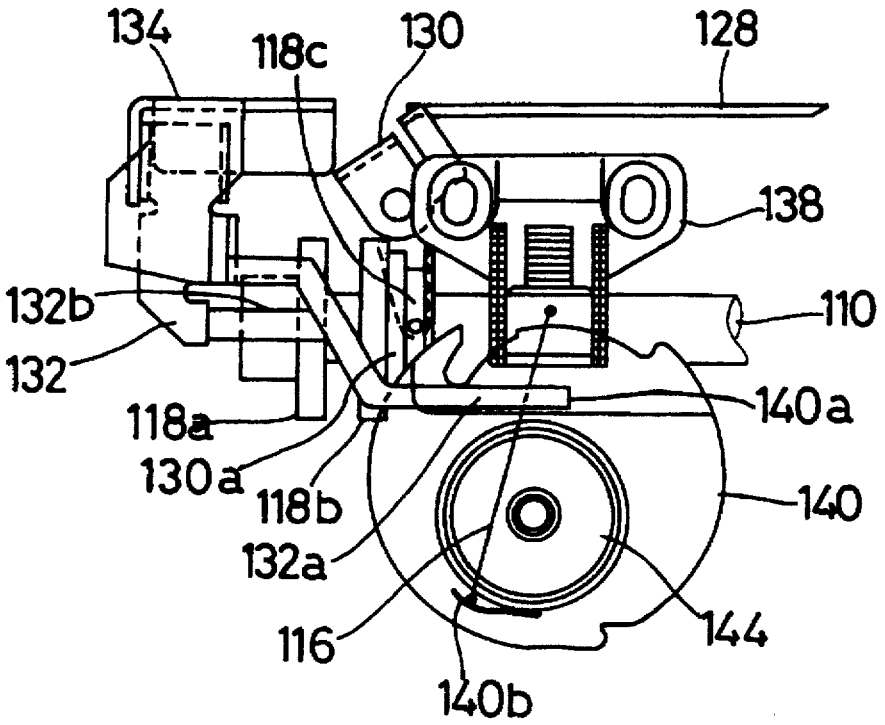
FIG. 8 is a view corresponding to FIG. 3, showing the lower-thread tension changing device of FIG. 6.

As shown in FIGS. 7 and 8, the cam moving member 130 has an end portion 130*a* which is engaged with a groove 118*c* of the second cam 118*b* at a bottom portion of the same 118*b*. When the cam moving member 130 is pivoted by the connecting rod 128, the second cam 118*b* is moved, on the lower shaft 110, between a first position thereof adjacent to the first cam 118*a* and a second position thereof away from the same 118*a*. The first and/or second cam surfaces 119*a*, 119*b* of the first and second cams 118*a*, 118*b* are/is engaged with, or followed by, a cam follower 132*b* as a part of a lower-thread tension changing member 132. The tension changing member 132 cooperates with a bobbin case 140 of the shuttle 113 to provide a pair of pinching members which pinch the lower thread 116 and changes a maximum tension of the lower thread 116 to a value corresponding to the stitch pattern selected by the user through the handle 120. The tension changing member 132 and the bobbin case 140 provides a variable-tension applying device of the sewing machine 101. The tension changing member 132 is supported by a base member 134, fixed to the machine frame 102, such that the tension changing member 132 is pivotable about an axis portion 134*a* of the base member 134.

As shown in FIG. 7, a work sheet such as a cloth or leather (not shown) is fed, by a feed dog 138 as a sheet feeding device, on a throat plate 136 having a needle throat or hole 136*a* through which the lower thread 116 is passed with being locked with the upper thread carried by the sewing needle. The throat plate 136 is movable relative to the machine frame 102. The bobbin case 140 is accommodated in the rotating hook 114. A lower-thread tension changing portion 132*a* of the tension changing member 132 cooperates with a top surface 140*a* of the bobbin case 140 to pinch the lower thread 116 therebetween and apply a frictional resistance to the thread 116 upon passing of the thread 116 therebetween. That is, the maximum tension of the lower thread 116 is changed or increased to such an extent that the drawing of the lower thread 116 is resisted but not completely inhibited. A spring 142 biases the cam follower 132*b* of the lower-thread tension changing member 132 to contact and follow the first cam surface 119*a*, or the first and second cam surfaces 119*a*, 119*b*, of the cam device 118, and simultaneously biases the lower-thread tension changing portion 132*a* toward the top surface 140*a* of the bobbin case 140.

As shown in FIG. 8, a bobbin 144 is accommodated in the bobbin case 140. The bobbin 144 is a lower-thread storage device in which the lower thread 116 is stored. The lower thread 116 is supplied from the bobbin 144 to a stitch forming device provided by the sewing needle connected to the upper shaft 106 and the rotating hook 114 connected to the lower shaft 110. A bobbin-case spring 140*b* engages the lower thread 116 just after the thread 116 comes out of the bobbin case 140. When the lower thread 116 is passed between the spring 140*b* and the bobbin case 140, the thread 116 is subjected to a frictional resistance which results in producing a constant tension in the thread 116 but not stopping the passing of the same 116. Thus, the spring 140*b* and the bobbin case 140 cooperate with each other to provide a constant-tension applying device of the sewing machine 101. The lower thread 116 is subsequently fed to the needle throat 136*a* of the throat plate 136 and cooperates with the upper thread to produce stitches on the work sheet being fed on the throat plate 136. The lower-thread tension changing portion 132*a* of the lower-thread tension changing member 132 and the top surface 140*a* of the bobbin case 140 cooperate with each other to pinch the lower thread 116 and apply an additional tension to the thread 116, at a position intermediate in a lower-thread supplying route from the bobbin 140 to the throat plate 136. The constant tension applied by the bobbin-case spring 140*b*, plus the variable tension applied by the tension changing member 132, does not completely stop the supplying of the lower thread 116 to the stitch forming device or the work sheet.

Next, there will be described in detail the operation of the sewing machine 101 constructed as described above.

Figure 9:
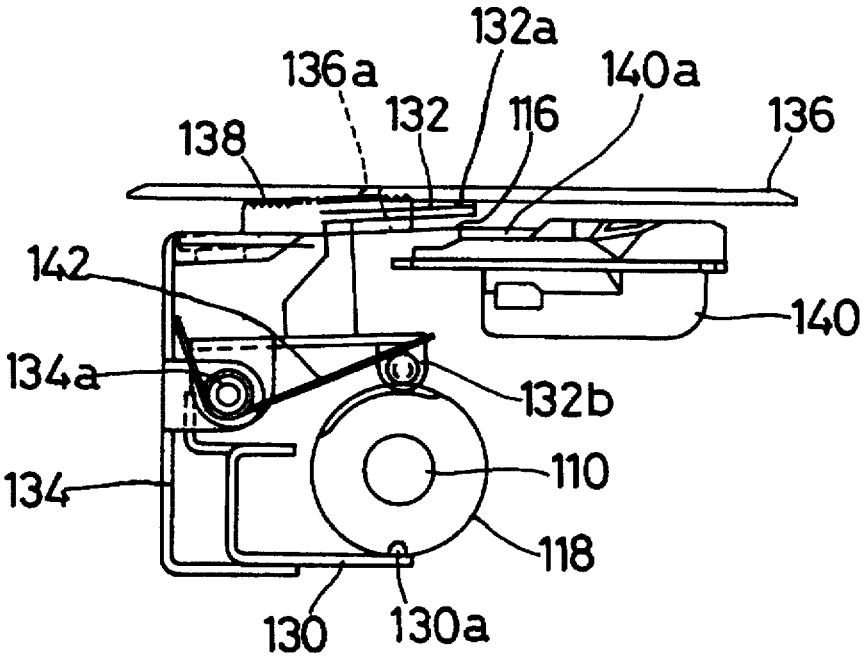
FIG. 9 is a view corresponding to FIG. 4, showing the lower-thread tension changing device of FIG. 6 which is held at an upper position thereof in which the changing device releases the lower thread.

As shown in FIGS. 7 and 9, when the sewing machine 101 is operated, i.e., when the lower shaft 110 is rotated by the motor 4, the cam device 118 secured to the shaft 110 is also rotated. Each stitch is formed on the work sheet while the lower shaft 110 is rotated one time, i.e., 360 degrees. Since the cam device 118 is rotated together with the lower shaft 110, each stitch is formed in one rotation cycle of the cam device 118. Since the cam follower 132*b* of the lower-thread tension changing member 132 contacts and follows the first and/or second cam surfaces 119*a*, 119*b* of the cam device 118, the tension changing member 132 swings according to the shape of the cam surfaces 119*a*, 119*b*, so that the lower-thread tension changing portion 132*a* of the tension changing member 132 cyclically moves up and down and the position of the tension changing portion 132*a* relative to the top surface 140*a* of the bobbin case 140 cyclically changes.

In FIGS. 9 and 11, since the cam follower 132*b* contacts a composite cam surface provided by the first and second cam surfaces 119*a*, 119*b* of the cam device 118, the tension changing portion 132*a* is always kept away from the bobbin-case top surface 140*a* against the biasing spring 142 so that the two portions 132*a*, 140*a* do not pinch the lower thread 116 or apply any frictional resistance to the thread 116 being supplied to the stitch forming device or the work sheet. The composite cam surface 119*a*, 119*b* corresponds to a needle-swing stitch pattern selected by the user via the handle 120. In forming a needle-swing stitch pattern, only the constant tension by the bobbin-case spring 140*b* is applied to the lower thread 116, whereas in forming a straight stitch pattern, the constant tension plus the variable tension by the tension changing member 132 is applied to the thread 116. Experiments show that the maximum lower-thread tension produced in forming a needle-swing stitch pattern is appreciably smaller than that produced in forming a straight stitch pattern. In forming a needle-swing stitch pattern, such as zigzag stitch, stitches are not tightened so strongly, so that soft stitches are produced on the work sheet.

On the other hand, when a straight stitch pattern is selected by the user via the handle 120, the cam follower 132*b* of the lower-thread tension changing member 132 engages only the first cam surface 119*a* of the first cam 118, as shown in FIGS. 7 and 10. In this case, since the cam follower 126*a* of the switching lever 126 engages a top portion of the cam surface 125 of the pattern detecting cam 124, the second cam 118*b* is kept away from the first cam 118*a* by the connecting rod 128 and the cam moving member 130. In FIG. 7, the cam follower 132*b* of the tension changing member 132 engages the bottom portion of the first cam surface 119*a*, and the tension changing portion 132*a* of the tension changing member 132 is pressed on the bobbin-case top surface 140*a* by the biasing spring 142. Thus, the lower thread 116 is pinched between the top surface 140*a* and the tension changing portion 132*a*, so that the thread 116 is subjected to a frictional resistance when being passed therebetween. The constant resistance produced by the bobbin-case spring 140*b* is always exerted to the lower thread 116. Thus, a greater resistance is exerted against the passing of the thread 116, but does not stop the drawing of the same 116 from the bobbin 144. In producing a straight stitch pattern, stitches are tightened strongly so that neat stitches are formed on the work sheet.

When a needle-swing stitch pattern is selected by rotating the handle 120, the cam follower 126*a* of the switching lever 126 is moved down to a bottom portion of the cam surface 125 of the pattern detecting cam 124. In this case, the second cam 118*b* is kept adjacent to the first cam 118*a* by the connecting rod 128 and the cam moving member 130, so that the cam follower 132*b* of the tension changing member 132 engages the composite cam surface of the first and second cam surfaces 119*a*, 119*b*, as shown in FIG. 11.

In FIG. 9, the cam follower 132*b* of the tension changing member 132 corresponds to the bottom portion of the first cam surface 119*a* of the first cam 118*a*. However, since the second cam 118*b* is positioned adjacent to the first cam 118*a*, the cam follower 132*b* contacts the higher one of the corresponding portions of the two cam surfaces 119a, 119b. Since the second cam surface 119b does not have any low or bottom portion and consists of the high or top surface corresponding to the top portion of the first cam surface 119a, it can be assumed that the cam follower 132b contacts the second cam surface 119b only, so that the tension changing portion 132a is kept away from the bobbin-case top surface 140a. Thus, the lower thread 116 is not pinched between the two elements 132a, 140a, and no additional resistance is exerted to the thread 116 being supplied from the bobbin 144 to the work sheet. Since the constant resistance produced by the bobbin-case spring 140b is always exerted to the lower thread 116, the thread 116 is subjected to only the constant resistance which resists to the drawing of the thread 116 but does not inhibit the drawing. The resistance exerted to the lower thread 116 in forming a needle-swing stitch pattern is smaller than that in forming a straight stitch pattern.

Figure 12:
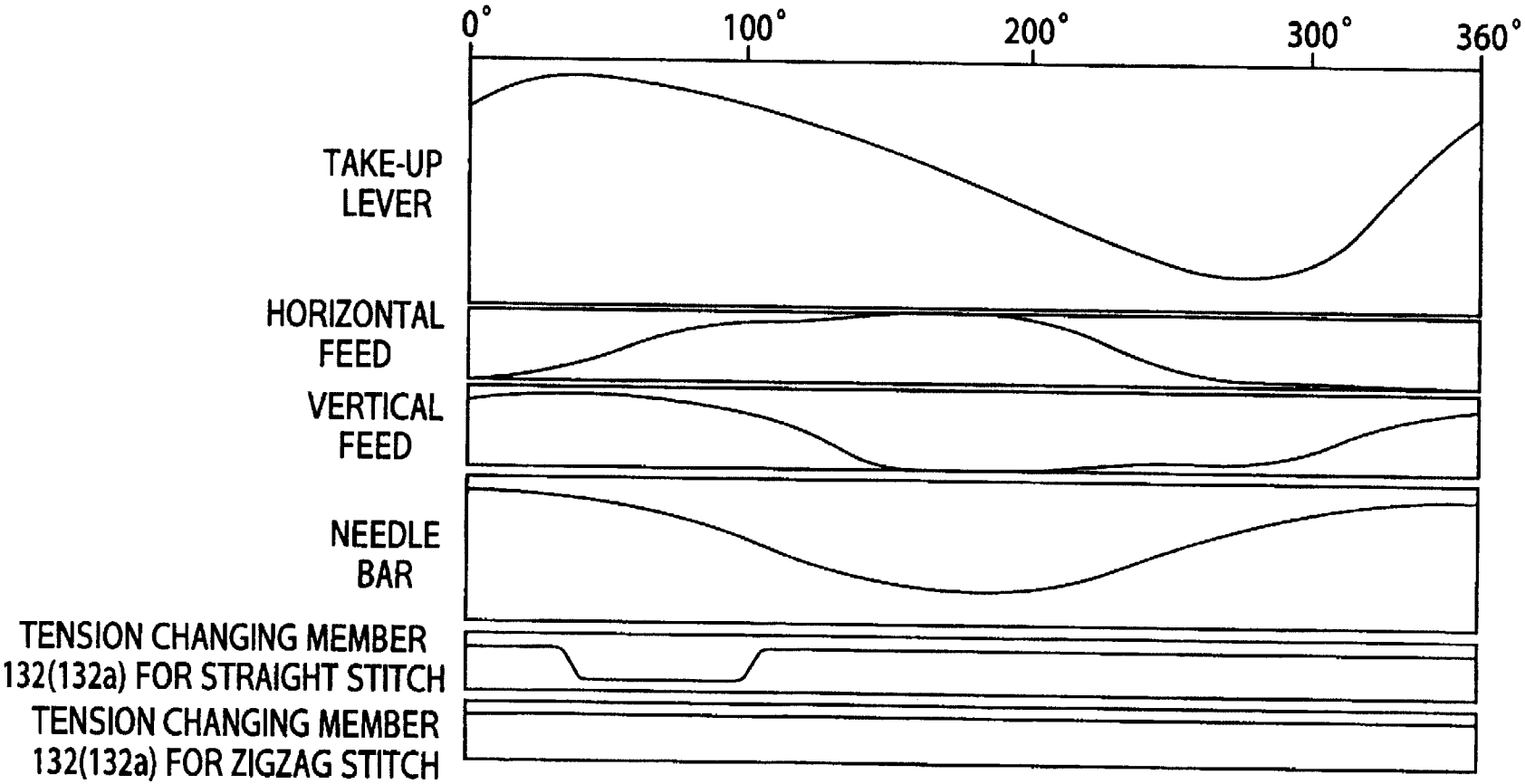
FIG. 12 is a timing chart corresponding to FIG. 5, showing the movements of various elements of the sewing machine of FIG. 6 during one revolution of an upper shaft of the same.

FIG. 12 shows a timing chart having an axis of abscissa indicative of a rotation angle, θ (θ=0 to 360 degrees), of the upper shaft 106 or lower shaft 110. The angle, θ=0 degree, corresponds to an upper dead position of a needle bar (not shown) to the lower end of which the sewing needle is secured; the angle, θ=180 degrees, corresponds to a lower dead position of the needle bar; and the angle, θ=360 degrees, is back again to the upper dead position of the needle bar (and one stitch is formed on the work sheet). The timing chart has six axes of ordinate one of which is indicative of an amount of vertical movement of an upper-thread take-up lever (not shown) of the sewing machine 101, the second of which is indicative of an amount of horizontal movement of the feed dog 138, the third of which is indicative of an amount of vertical movement of the feed dog 138, the fourth of which is indicative of an amount of vertical movement of the needle bar, the fifth of which is indicative of an amount of vertical movement of the lower-thread tension changing portion 132a of the tension changing member 132 in forming straight stitches as a straight stitch pattern, and the sixth of which is indicative of an amount of vertical movement of the tension changing portion 132a in forming zigzag stitches as a needle-swing stitch pattern.

At the angle θ=0 degree, the needle bar starts to move downward from the upper dead position thereof. At that time, the upper-thread take-up lever is moving upward to tighten the upper thread, and subsequently the feed dog 138 starts to feed the work sheet. In the case of a straight stitch pattern, then, the tension changing portion 132a is held at a lower position thereof where the tension changing portion 132a contacts the bobbin-case top surface 140a to pinch the lower thread 116 and apply an additional tension to the thread 116. Each stitch is formed in the work sheet in such a manner that the lower thread 116 is tightened simultaneously with the tightening of the upper thread. Thus, the loosening of the lower thread 116 as well as the upper thread is effectively prevented.

After the tightening of the threads is completed, the lower shaft 110 is further rotated so that the cam follower 132b of the lower-thread tension changing member 132 contacts the top portion of the first cam surface 119a of the first cam 118a. Consequently the tension changing portion 132a starts to move upward to an upper portion thereof where the tension changing portion 132a is away from the bobbin-case top surface 140a, releases the lower thread 116, and permits the the thread 116 to be drawn from the bobbin 144 during the feeding of the work sheet by the feed dog 138. When the upper shaft 106 is further rotated, the needle bar reaches the lower dead position thereof and then starts to move upward, so that the upper thread carried by the needle makes a loop which in turn is caught by a point-of-hook of the rotating hook 114 and is passed around the bobbin case 140. Thus, the upper thread is locked with the lower thread 116. The upper and lower shafts 106, 110 are further rotated, and one rotation cycle of the cam device 118 is completed. Thus, each stitch is formed in the work sheet.

In the case of a needle-swing stitch pattern, the tension changing portion 132a does not contact the bobbin-case top surface 140a, in contrast to the case of a straight stitch pattern. At the angle θ=0 degree, the needle bar starts to move downward from the upper dead position thereof, and the upper-thread take-up lever moves upward to tighten the upper thread, and subsequently the feed dog 138 starts to feed the work sheet. Each stitch is formed in the work sheet in such a manner that the lower thread 116 is not tightened so strongly at the time of tightening of the upper thread. Thereafter, when the upper shaft 106 is further rotated, the needle bar reaches the lower dead position thereof and then starts to move upward, so that the upper thread carried by the needle makes a loop which in turn is caught by a point-of-hook of the rotating hook 114 and is passed around the bobbin case 140. Thus, the upper thread is locked with the lower thread 116. The upper and lower shafts 106, 110 are further rotated, and one rotation cycle of the cam device 118 is completed. Thus, each stitch is formed in the work sheet.

In the sewing machine 101 as the second embodiment of the present invention, the user is only required to select a desired stitch pattern by rotating the pattern selecting handle 120, and is not required to do any other operation to change the maximum tension of the lower thread 116 to the most suitable value for the selected stitch pattern. The present sewing machine 101 can appropriately control the tension of the lower thread 116 for each of various stitch patterns, with reliability and stability, and can be manufactured in a small size and at a low cost.

The position of locking of the upper and lower threads varies in the work sheet depending on the balancing of the respective tensions of the two threads. In the sewing machine 101, the maximum tension of the lower thread 116 is changed to be suitable for a selected stitch pattern. Consequently the position of locking of the upper and lower threads is adjusted to be suitable for the selected stitch pattern. In addition, the tension of the lower thread 116 is changed to be balanced with the tension of the upper thread, in contrast to a conventional method in which a lower thread is reeled off in advance before the upper thread is drawn by the take-up lever. Thus, the changing of tension of the lower thread 116 is satisfactorily performed. When the upper thread is tightened by the take-up lever, the lower thread 116 is subjected to the tension produced by the tension changing device 115. Since the lower thread 116 is not loose in this situation, the thread 116 is not entangled or caught by anything before the upper thread locked with the lower thread 116 is tightened by the take-up lever. In the above conventional method, the reeled-off lower thread is loose and therefore may be entangled, or caught by other elements before the upper thread is tightened.

Next, there will be described a third embodiment of the present invention by reference to FIGS. 13 through 17. The third embodiment relates to a sewing machine which has a construction similar to that of the sewing machine 101 shown in FIGS. 6 through 9 but includes a lower-thread tension changing device 215 in place of the corresponding device 115 of the sewing machine 101. The tension changing device 215 changes a tension of a lower thread 216 to stop the supplying of the thread 216 to a work sheet on which stitches are formed by a stitch forming device provided by a sewing needle connected to an upper shaft 106 (FIG. 6) and a rotating hook 114 (FIG. 6) connected to a lower shaft 210. The tension changing device 215 holds the lower thread 216 such that the drawing of the thread 216 is impossible, thereby controlling the amount of supplying of the thread 216 to the stitch forming device. Hereinafter, there will be described only the differences of the third embodiment from the sewing machine 101 as the second embodiment.

A cam device 248 as a part of the lower-thread tension changing device 215 is secured to a portion of the lower shaft 210 which portion is nearer to a free end of the shaft 210 than a gear 112 (FIG. 6). The cam device 248 is rotated together with the lower shaft 210. The cam device 248 includes a first and a second cam 248*a*, 248*b* which have a first and a second cam surface 249*a*, 249*b* (FIGS. 15 and 16), respectively. The first cam 248*a* corresponds to one or more straight stitch patterns, and the first and second cams 248*a*, 248*b* correspond to one or more needle-swing stitch patterns. Each of the stitch patterns is selectable by a pattern selecting handle 120 (FIG. 6). The second cam 248*b* is movable relative to the first cam 248*b* on the lower shaft 210 in an axial direction of the shaft 210. A biasing device such as a spring (not shown) causes the second cam 248*b* to be located at a predetermined position away from the first cam 248*a*. The two cams 248*a*, 248*b* are rotated together with the lower shaft 210.

A cam moving member 230 has an end portion 230*a* which is engaged with a groove 248*c* of the second cam 248*b* at a bottom portion of the same 248*b*. When the cam moving member 230 is moved by a connecting rod 128 (FIG. 6), the second cam 248*b* is moved, on the lower shaft 210, between a first position thereof adjacent to the first cam 248*a* and a second position thereof away from the same 248*a*. The first and/or second cam surfaces 249*a*, 249*b* of the first and second cams 248*a*, 248*b* are/is engaged with, or followed by, a cam follower 232*b* as a part of a lower-thread stopping member 232. The stopping member 232 cooperates with a bobbin case 240 to provide a pair of pinching members which pinch and hold the lower thread 216 and change a tension of the thread 216 to stop the supplying of the thread 216 to the work sheet. The stopping member 232 is supported by a base member 234, fixed to a machine frame 102 (FIG. 6), such that the stopping member 232 is pivotable about an axis portion 234*a* of the base member 234.

The bobbin case 240 is accommodated in the rotating hook 214. A lower-thread holding portion 232*a* of the stopping member 232 cooperates with a top surface 240*a* of the bobbin case 240 to pinch the lower thread 216 therebetween and apply a frictional resistance to the thread 216 upon passing of the thread 216 therebetween. Thus, the maximum tension of the lower thread 216 is changed or increased to such an extent that the drawing of the thread 216 is impossible and completely inhibited. A spring 242 biases the cam follower 232*b* of the lower-thread stopping member 232 to contact and follow the first cam surface 249*a*, or the first and second cam surfaces 249*a*, 249*b*, of the cam device 248, and simultaneously biases the lower-thread holding portion 232*a* toward the top surface 240*a* of the bobbin case 240.

There will be described in detail the operation of the sewing machine as the third embodiment.

Figure 13:
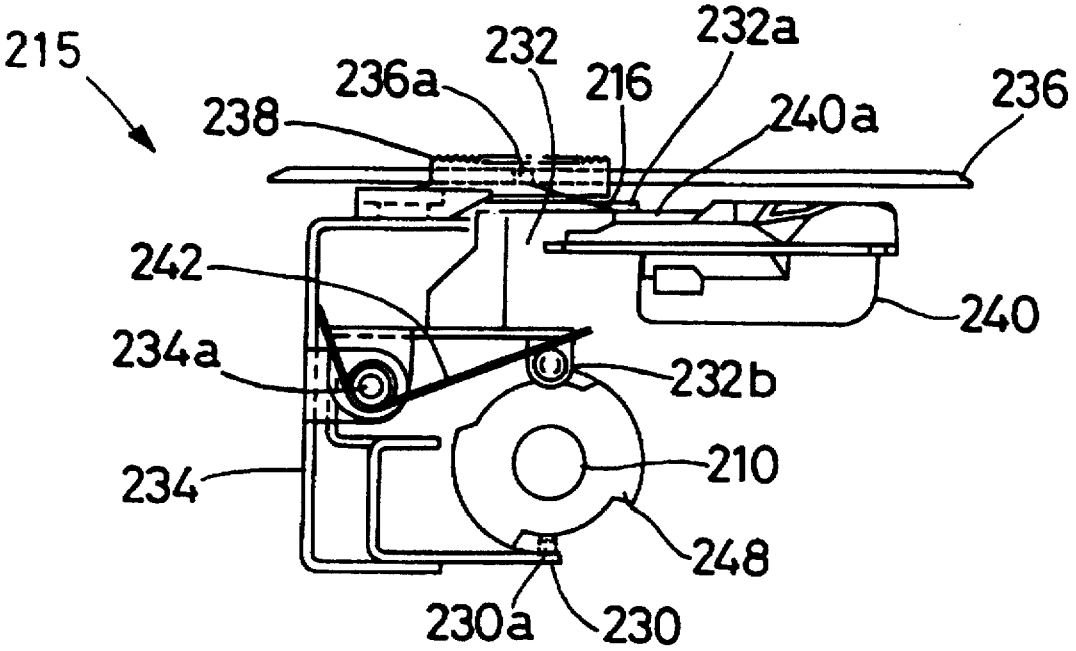
FIG. 13 is a view corresponding to FIG. 7, showing another sewing machine as a third embodiment of the present invention, the sewing machine having a lower-thread tension changing device which is currently held at a lower position thereof in which the changing device pinches and holds a lower thread.
Figure 14:
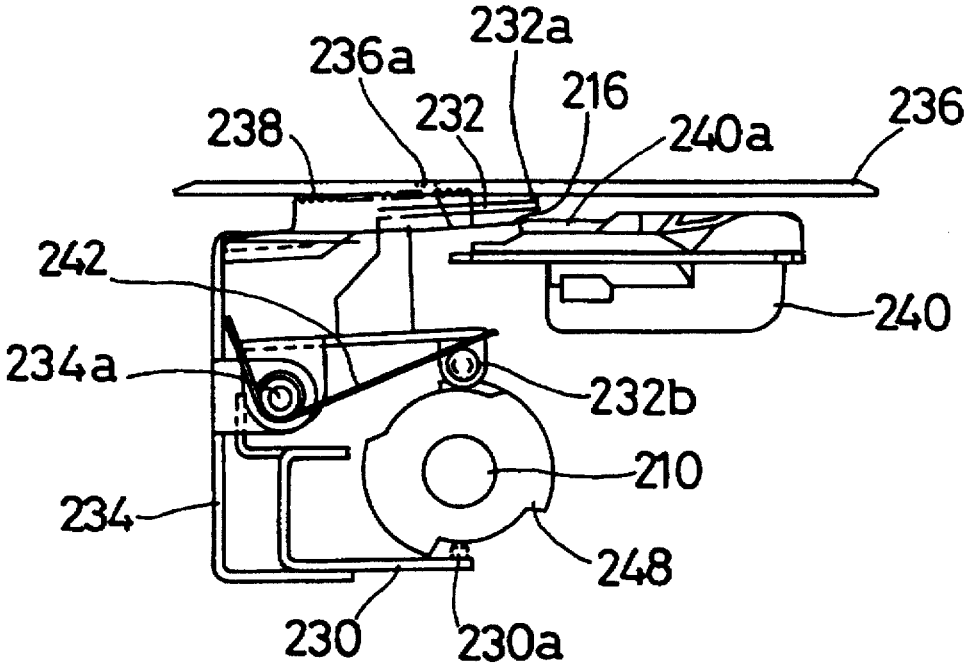
FIG. 14 is a view corresponding to FIG. 9, showing the lower-thread tension changing device of FIG. 13 which is held at an upper position thereof in which the changing device releases the lower thread.

In FIGS. 13 and 14, when the sewing machine is operated, i.e., when the lower shaft 210 is rotated by an electric motor 104 (FIG. 6), the cam device 248 secured to the shaft 210 is also rotated. Each stitch is formed on the work sheet while the lower shaft 210 is rotated one time, i.e., 360 degrees. Since the cam device 248 is rotated together with the lower shaft 210, each stitch is formed in one rotation cycle of the cam device 248. Since the cam follower 232*b* of the lower-thread stopping member 232 contacts and follows the first and/or second cam surfaces 249*a*, 249*b* of the cam device 248, the stopping member 232 swings according to the shape of the cam surfaces 249*a*, 249*b*, so that the lower-thread holding portion 232*a* of the stopping member 232 cyclically moves up and down and the position of the holding portion 232*a* relative to the top surface 240*a* of the bobbin case 240 cyclically changes.

When a straight stitch pattern is selected by a user in rotating the pattern selecting handle 120, the cam follower 232*b* of the lower-thread stopping member 232 engages only the first cam surface 249*a* of the first cam 248, as shown in FIGS. 13 and 15. In this case, since a cam follower 126*a* of a switching lever 126 (FIG. 6) engages a top portion of a cam surface 125 of a pattern detecting cam 124 (FIG. 6), the second cam 248*b* is kept away from the first cam 248*a* by the connecting rod 128 and the cam moving member 230. In FIGS. 13 and 15, the cam follower 232*b* of the stopping member 232 is engaged with a bottom portion of the first cam surface 249*a*, and the holding portion 232*a* of the stopping member 232 is pressed on the bobbin-case top surface 240*a* by the biasing spring 242. Thus, the lower thread 216 is pinched between the top surface 240*a* and the holding portion 232*a*, so that the thread 216 is subjected to a great frictional resistance and the drawing of the thread 216 is stopped or inhibited.

In FIGS. 14 and 16, since the cam follower 232*b* contacts a composite cam surface provided by the first and second cam surfaces 249*a*, 249*b* of the cam device 248, the lower-thread holding portion 232*a* is positioned away from the bobbin-case top surface 240*a* against the biasing spring 242 so that the two elements 232*a*, 240*a* do not pinch the lower thread 216 or apply any frictional resistance to the thread 216 being supplied to the stitch forming device or the work sheet. The composite cam surface 249*a*, 249*b* corresponds to a needle-swing stitch pattern selected by the user via the handle 120. In FIGS. 14 and 16, the cam follower 232*b* of the stopping member 232 corresponds to one of two bottom portions of the first cam surface 249*a* of the first cam 248*a*. However, since the second cam 248*b* is positioned adjacent to the first cam 248*a*, the cam follower 232*b* contacts the higher one of the corresponding portions of the two cam surfaces 249*a*, 249*b*. Accordingly, the cam follower 232*b* contacts one of two top portions of the second cam surface 249*b*, so that the lower-thread holding portion 232*a* is positioned away from the bobbin-case top surface 240*a*. Thus, the lower thread 216 is not pinched between the two elements 232*a*, 240*a*, and no resistance is exerted to the thread 216 being supplied from a bobbin 144 (FIG. 8) to the work sheet.

The angular amount (from point V1 to point W in FIG. 17) of one of the two top portions of the first cam surface 249*a* is smaller than that (from point V2 to point W) of a corresponding one of the two top portions of the second cam surface 249*b*, as shown in FIG. 15 or 16. Thus, the supply amount of the lower thread 216 consumed to form each stitch of a straight stitch pattern is smaller than that consumed to form each stitch of a needle-swing stitch pattern. In other words, in forming a straight stitch pattern, stitches are tightened strongly and neat stitches are formed on the work sheet, whereas in forming a needle-swing stitch pattern, stitches are not tightened so strongly and soft stitches are formed.

Figure 17:
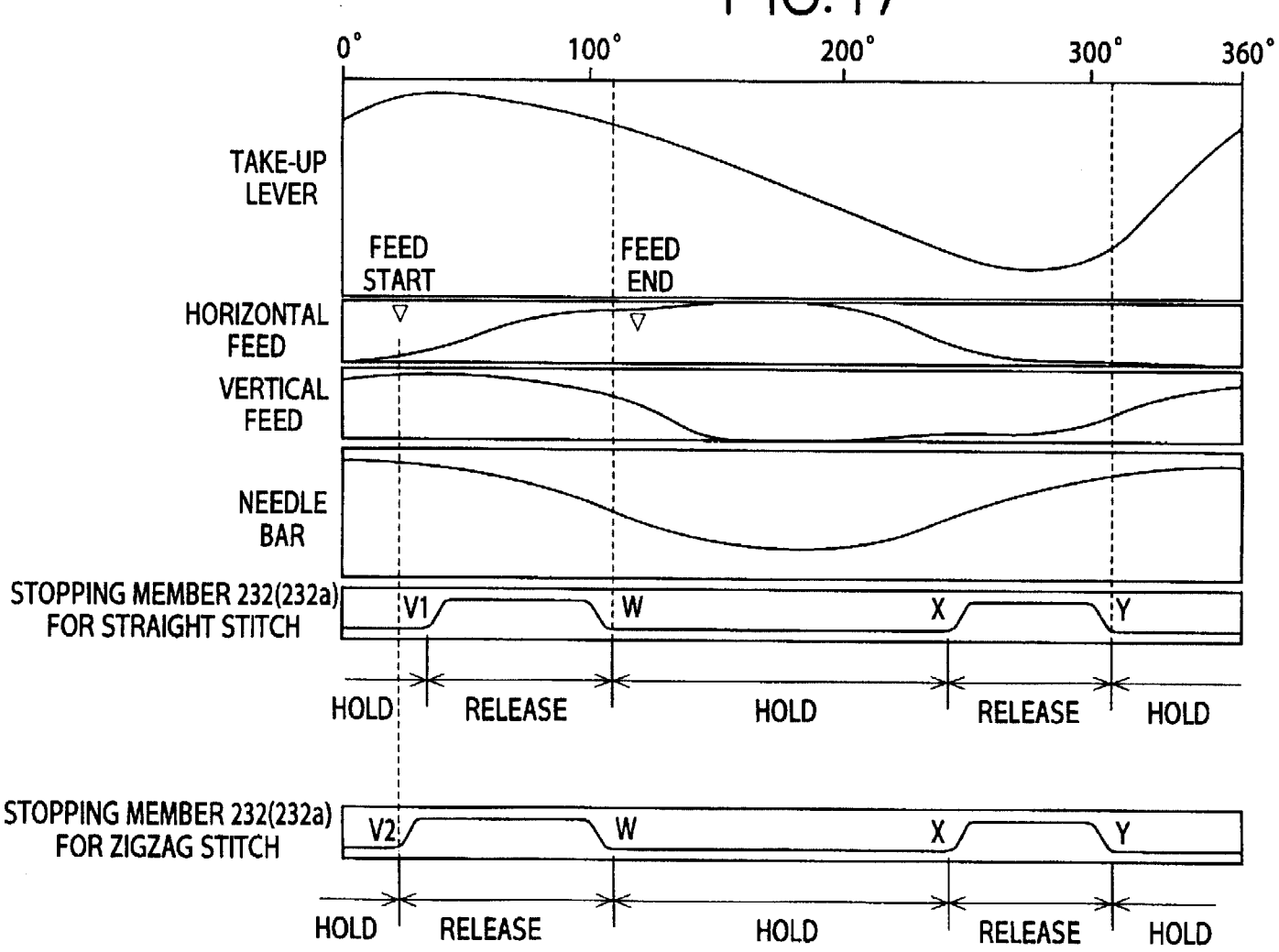
FIG. 17 is a timing chart corresponding to FIG. 12, showing the movements of some elements of the sewing machine of FIG. 6 and the movements of the lower-thread stopping member of the changing device of FIG. 13, during one revolution of an upper shaft of the sewing machine.

FIG. 17 shows a timing chart having an axis of abscissa indicative of a rotation angle, θ (θ=0 to 360 degrees), of the upper shaft 106 or lower shaft 210. The angle, θ=0 degree, corresponds to an upper dead position of a needle bar to the lower end of which the sewing needle is secured; the angle, θ=180 degrees, corresponds to a lower dead position of the needle bar; and the angle, θ=360 degrees, is back again to the upper dead position of the needle bar so that each stitch is formed on the work sheet. The timing chart has six axes of ordinate the first of which is indicative of an amount of vertical movement of an upper-thread take-up lever of the sewing machine, the second of which is indicative of an amount of horizontal movement of a feed dog 238, the third of which is indicative of an amount of vertical movement of the feed dog 238, the fourth of which is indicative of an amount of vertical movement of the needle bar, the fifth of which is indicative of an amount of vertical movement of the lower-thread holding portion 232*a* of the stopping member 232 in forming straight stitches as a straight stitch pattern, and the sixth of which is indicative of an amount of vertical movement of the tension changing portion 232*a* in forming zigzag stitches as a needle-swing stitch pattern.

At the angle θ=0 degree, the needle bar starts to move downward from the upper dead position thereof. At that time, the upper-thread take-up lever is moving upward to tighten the upper thread, and subsequently the feed dog 238 starts to feed the work sheet. In this situation, the lower-thread holding portion 232*a* is held at a lower position thereof where the holding portion 232*a* contacts the bobbin-case top surface 240*a* to pinch and hold the lower thread 216 and stop the supplying of the thread 216. Thus, the lower thread 216 is not consumed. Each stitch is formed in the work sheet in such a manner that the lower thread 116 is tightened simultaneously with the tightening of the upper thread. The loosening of the lower thread 216 as well as the upper thread is effectively prevented.

After the tightening of the threads is completed, the lower shaft 210 is further rotated so that the cam follower 232*b* of the lower-thread stopping member 232 contacts one of the two top portions of the first cam surface 249*a* of the first cam 218*a*, at point V1 in FIG. 17, or one of the two top portions of the composite cam surface provided by the first and second cam surfaces 249*a*, 249*b*, at point V2 different in angular phase from point V1. Consequently the lower-thread holding portion 232*a* starts to move upward to an upper portion thereof where the holding portion 232*a* is away from the bobbin-case top surface 240*a*, releases the lower thread 216, and permits the thread 216 to be supplied from the bobbin 144 for the feeding of the work sheet by the feed dog 238. Thus, the time duration in which the supplying of the lower thread 216 is permitted to form each stitch of a straight stitch pattern, is shorter than that to form each stitch of a needle-swing stitch pattern.

When the upper shaft 106 is further rotated, the feeding of the work sheet is completed and the cam follower 232*b* of the lower-thread stopping member 232 contacts one of the two bottom portions of the first cam surface 249*a* or the composite cam surface 249*a*, 249*b*, so that the holding portion 232*a* moves downward, at point W in FIG. 17, to the lower position thereof where the holding portion 232*a* cooperates with the bobbin-case top surface 240*a* to pinch and hold the lower thread 216. The supplying of the lower thread 216 is inhibited and no unnecessary amount of the thread 216 is consumed. Thus, the present sewing machine effectively prevents the supplying of unnecessary amounts of the lower thread 216 which results in lowering the quality of the sewing product. Around point W, the sewing needle secured to the needle bar reaches the work sheet.

When the upper shaft 106 is further rotated, the needle bar reaches the lower dead position thereof and then starts to move upward, so that the upper thread carried by the needle makes a loop which in turn is caught by a point-of-hook of the rotating hook 114 and is passed around the bobbin case 240. If in this situation the holding portion 232*a* is held at the lower position thereof in which the holding portion 232*a* contacts the bobbin-case top surface 240*a*, the loop of the upper thread cannot be passed around the bobbin case 240. Therefore, when the upper-thread loop is passed around the bobbin case 240, the cam follower 232*b* is temporarily engaged with another top portion of the first cam surface 249*a* or the composite cam surface 249*a*, 249*b*, so that the holding portion 232*a* moves upward, at a point, X, to the upper position thereof. Thus, the upper thread can be locked with the lower thread 216. After the upper thread is passed around the bobbin case 240, the cam follower 232*b* again contacts the first bottom portion of the first cam surface 249*a* or the composite cam surface 249*a*, 249*b*, so that the holding portion 232*a* moves downward, at a point, Y, to the lower position thereof to pinch and hold the lower thread 216. The upper and lower shafts 106, 210 are further rotated, and one rotation cycle of the cam device 248 is completed. Thus, each stitch is formed in the work sheet.

Although in the second embodiment the balance of the respective tensions of the upper and lower threads may be lost if the upper thread has an unexpected tension, the control of supply amount of the lower thread 216 in the third embodiment is free of influences from the tension of the upper thread. Therefore, the sewing machine as the third embodiment supplies the lower thread 216 with higher stability. Since the lower-thread tension changing device 215 directly acts on the lower thread 216, without using any intervening elements, the sewing machine can control the supply amount of the thread 216 with accuracy.

The supplying of the lower thread 216 is permitted when the work sheet is fed, or when the upper thread is locked with the lower thread 216. In those situations, the lower thread 216 can smoothly be drawn with a very small force, so that no great force is applied to the work sheet and no shrink of the sheet results. Even with a thin work sheet, stitches are formed with high quality. Even in the case where a great tension is produced in the upper thread because of the occurrence of an unexpected accident to the upper thread or other causes though the supplying of the lower thread 216 is not required, the sewing machine as the third embodiment effectively prevents unnecessary consumption of the thread 216. The tightening of the threads is the most important in the formation of stitches. In the third embodiment, the tightening of the upper thread does not occur before a needed amount of the lower thread 216 is supplied during the feeding of the work sheet and the drawing of a further amount of the thread 216 is inhibited. Thus, neat stitches are formed with reliability.

The lower-thread tension changing device 215 does not require any calculation or data processing and therefore does not employ any calculating or data processing device such as a computer, or any additional actuator or sensor. Thus, the sewing machine can be produced in a small size and at a low cost. The tension changing device 215 does not need any time for calculation or data processing, and is free from any time loss between the production of a command to start the operation of an actuator or a sensor and the actual starting of operation, or any delayed time from the detection of a sensor at a position away from the place where stitches are formed on the work sheet, to the actual operation of an actuator in response to the detection of the sensor. The sewing machine as the third embodiment can form uniform and neat stitches from the first stitch to the last of each stitch pattern.

While the present invention has been described in its preferred embodiments, the invention may otherwise be embodied.

For example, although in the first embodiment shown in FIGS. 1 to 5 the holding portion 18*a* of the stopping member 18 and the top surface 26*a* of the bobbin case 26 provide a pair of pinching members for pinching the lower thread 24, it is possible to replace the elements 18*a*, 26*a* by other pinching devices which can pinch and hold the thread 24. For example, a pinching device may be provided by using one or more of the rotating hook 14, bobbin 30, throat plate 22, feed dog 23, a portion of the machine frame 2, a stopper (not shown) for stopping the bobbin case 26, and a cutting member (not shown) for cutting the thread 24.

Although in the second embodiment shown in FIGS. 6 to 12 the bobbin-case spring 140*b* and the bobbin case 140, or the tension changing portion 132*a* of the tension changing member 132 and the top surface 140*a* of the bobbin case 140, provide a pair of pinching members for pinching the lower thread 116, it is possible to replace the elements 140*b*, 140, or the elements 132*a*, 140*a*, by other pinching devices which can pinch the thread 116. For example, a pinching device may be provided by using one or more of the rotating hook 114, bobbin 144, throat plate 136, feed dog 138, a portion of the machine frame 102, a stopper for stopping the bobbin case 140, and a cutting member for cutting the thread 116.

Although in the third embodiment shown in FIGS. 13 to 17 the holding portion 232*a* of the stopping member 232 and the top surface 240*a* of the bobbin case 240 provide a pair of pinching members for pinching the lower thread 216, it is possible to replace the elements 232*a*, 240*a* by other pinching devices which can hold and release the thread 216. For example, a pinching device may be provided by using one or more of the rotating hook 114, bobbin 144, throat plate 236, feed dog 238, a portion of the machine frame 102, a stopper for stopping the bobbin case 240, and a cutting member for cutting the thread 216.

While in the first embodiment the cam device 16 attached to the lower shaft 10 is used for actuating the lower-thread stopping member 18, the cam device 16 may be replaced by other actuators which can control the operation of the stopping member 18. For example, an exclusive actuator such as a solenoid or a motor may be connected to the stopping member 18 via a link member for operating the stopping member 18 in synchronism with the rotation of the lower shaft 10.

In the second embodiment, the frictional resistance exerted to the lower thread 116 to produce a tension in the thread 116 may be replaced by a magnetic force exerted to the rotation of the bobbin 144.

While in the second embodiment the lower-thread tension changing device 115 changes the maximum tension of the lower thread 116 in two steps or values, it is possible to modify the changing device 115 to change the lower-thread tension in three or more steps or values.

While in the third embodiment the cam device 248 attached to the lower shaft 210 is used for actuating the lower-thread stopping member 232, the cam device 248 may be replaced by other actuators which can control the operation of the stopping member 232. For example, an exclusive actuator such as a solenoid or a motor may be used for controlling the operation of the stopping member 232.

In each of the three embodiments, the phase information needed for operating the lower-thread stopping member 18, 232 or the lower-thread tension changing member 132 is obtained from the cam device 16, 118, 248 secured to the lower shaft 10, 110, 210. However, it is possible to obtain the phase information from the upper shaft 6, 106, a vertical shaft (not shown), an axis member of the rotating hook 14, 114, electric motor 4, 104, or driving belt 8, 108. In addition, the cam device 16, 118, 248 may be replaced by a rotary encoder or a photocoupler.

In each of the second and third embodiments the selected-pattern detecting device is provided by the selected-pattern detecting cam 124 and the switching lever 126. However, the elements 124, 126 may be replaced by other selected-pattern detecting devices such as a contact-type mechanical switch, a non-contact sensor, or a computer.

In each of the second and third embodiments the pattern selecting device provided by the pattern selecting handle 120 and the pattern selecting cam 122 are connected to the lower-thread tension changing device 115, 215 via a mechanical connecting device provided by the pattern detecting cam 124, switching lever 126, and connecting rod 128. However, the former device may be electrically coupled to the latter device. For example, the second cam member 118*b*, 248*b* may be moved by an exclusive actuator such as a solenoid or a motor.

It is to be understood that the present invention may be embodied with other changes, improvements, and modifications that may occur to those skilled in the art without departing from the spirit and scope of the invention defined in the appended claims.

What is claimed is:

1. A sewing machine comprising:

a stitch forming device which forms stitches on a work sheet by locking an upper and a lower thread with each other, said stitch forming device including a throat plate having a needle throat, and including a sewing needle which carries said upper thread and reciprocates through said needle throat of said throat plate;

a sheet feeding device which intermittently feeds said work sheet over said needle throat of said throat plate;

a lower-thread storage device in which said lower thread is stored, the lower thread being supplied from said lower-thread storage device to said stitch forming device; and a tension changing device which changes a tension of said lower thread to stop the supplying of the lower thread from said lower-thread storage device to said stitch forming device, said tension changing device comprising a pinching device which pinches said lower thread at a position intermediate in a lower-thread supply route from said lower-thread storage device to said needle throat of said throat plate, said pinching device pinching said lower thread in each of a first and a second predetermined time duration during each reciprocation of said sewing needle, so as to stop the supplying of the lower thread, and releasing the pinched lower thread in each of a third and a fourth predetermined time duration during each reciprocation of the sewing needle, said pinching device pinching said lower thread in said each of said first and second time durations which come, during said each reciprocation of the sewing needle, before and after said third time duration, respectively, said third time duration at least partially overlapping a fifth predetermined time duration in which said work sheet is fed by said sheet feeding device, said pinching device releasing said lower thread in said fourth time duration which comes after said second time duration and before said first time duration and in which a loop of said upper thread is passed around said lower-thread storage device.

2. A sewing machine according to claim 1, wherein said pinching device comprises a pair of pinching members, said tension changing device further comprising an actuator which moves one of said pair of pinching members relative to the other pinching member, between an operative position thereof in which the two pinching members cooperate with each other to pinch said lower thread to stop said supplying of the lower thread and an inoperative position thereof in which the two pinching members do not pinch the lower thread and permits said supplying of the lower thread.

3. A sewing machine according to claim 2, wherein said other pinching member comprises a bobbin case in which a bobbin is accommodated, said lower thread being stored in said bobbin case such that the lower thread is wound around said bobbin.

4. A sewing machine according to claim 2, wherein said stitch forming device comprises a shuttle supplying said lower thread, and a driving device for driving said needle and said shuttle, said actuator being connected to said driving device so that the actuator actuates said one pinching member at a same period as a period at which the driving device operates for driving the needle and the shuttle.

5. A sewing machine according to claim 1, wherein said driving device comprises a driving motor, an upper rotary shaft connected to said driving motor and said needle, and a lower rotary shaft connected to the driving motor and said shuttle, said actuator comprising a cam member which is fixed to said lower rotary shaft and has a cam surface, a cam follower, and a biasing member for biasing said cam follower to contact and follow said cam surface of said cam member when the cam member is rotated with the lower rotary shaft, said one pinching member being fixed to said cam follower.

6. A sewing machine according to claim 5, wherein said cam surface of said cam member comprises at least two first surface portions each of which causes said one pinching member to move to said operative position thereof and at least two second surface portions each of which causes said one pinching member to move to said inoperative position thereof away from the operative position, said two first surface portions corresponding to said first and second time durations, respectively, said two second surface portions corresponding to said third and fourth time durations, respectively.

7. A sewing machine according to claim 1, further comprising an upper-thread taking-up device which intermittently takes up said upper thread as said stitch forming device forms said stitches on said work sheet by locking said upper and lower threads with each other, said first time duration in which said supplying of said lower thread is stopped starting when said upper-thread taking-up device starts each intermittent taking-up of the upper thread, and ending when said upper-thread taking-up device ends said each intermittent taking-up of the upper thread.

8. A sewing machine according to claim 1, further comprising a pattern selecting device which selects one of a plurality of different stitch patterns, said tension changing device stopping said supplying of said lower thread at said predetermined timing, when said pattern selecting device selects a first stitch pattern of said plurality of stitch patterns, and permitting said supplying of the lower thread at said predetermined timing, when said pattern selecting device selects a second stitch pattern of said different stitch patterns.

9. A sewing machine according to claim 8, wherein said second stitch pattern includes stitches formed by laterally swinging a sewing needle with respect to a direction of feeding of said work sheet, and said first stitch pattern consists of stitches which do not include any stitches-formed by laterally swinging said needle.

10. A sewing machine according to claim 8, wherein said pattern selecting device comprises a designating device which is operable by a user for designating one of said stitch patterns.

11. A sewing machine according to claim 8, wherein said pattern selecting device comprises a first movable member which is movable to one of a plurality of different positions thereof which corresponds to said one stitch pattern selected thereby, and said tension changing device comprises a second movable member which is movable to one of a plurality of different positions thereof which corresponds to the selected one stitch pattern, the sewing machine further comprising a connecting device which is connected to said first and second movable members of said pattern selecting device and said tension changing device to convert the motion of said first movable member to said one position thereof corresponding to said selected one stitch pattern, to the motion of said second movable member to said one position thereof corresponding to said selected one stitch pattern.

12. A sewing machine according to claim 11, wherein said stitch forming device comprises an upper rotary shaft connected to a sewing needle carrying said upper thread, a lower rotary shaft connected to a shuttle supplying said lower thread, and a driving device for rotating said upper and lower rotary shafts, and wherein said tension changing device comprises a first and a second cam member each of which is fixed to said lower rotary shaft such that each cam member is not rotatable about the lower rotary shaft and said second cam member is movable relative to said first cam member on the lower rotary shaft and which have a first and a second cam surface, respectively, a cam follower which contacts and follows at least one of said first and second cam surfaces, and a biasing device which biases said cam follower to contact and follow said at least one of said first and second cam surfaces, said second movable member of said tension changing device comprising said second cam member, said connecting device transmitting said motion of said first movable member to said second cam member to move the second cam member relative to said first cam member between a first position thereof in which the second cam member is away from the first cam member having said first cam surface which is followed by said cam follower, and a second position thereof in which the second cam member is adjacent to the first cam member to provide a composite cam surface which consists of said first and second cam surfaces and is followed by the cam follower, said first cam surface and said composite cam surface corresponding to a first and a second stitch pattern selected from said different stitch patterns by said pattern selecting device, respectively.

13. A sewing machine according to claim 12, wherein said first cam surface of said first cam member includes a first surface portion thereof having a first angular amount corresponding to said first stitch pattern, and said composite cam surface of said first and second cam members includes a second surface portion thereof having a second angular amount corresponding to said second stitch pattern, said tension changing device stopping said supplying of said lower thread while said cam follower contacts and follows each of said first and second surface portions.

14. A sewing machine according to claim 13, wherein said second stitch pattern includes stitches formed by laterally swinging said needle with respect to a direction of feeding of said work sheet, and said first stitch pattern consists of stitches which do not include any stitches formed by laterally swinging said needle, said first angular amount being greater than said second angular amount so that an amount of supplying of said lower thread for said first stitch pattern is less than an amount of supplying of the lower thread for said second stitch pattern.

15. A sewing machine according to claim 8, further comprising a detecting device which detects said one stitch pattern selected by said pattern selecting device, said tension changing device stopping and permitting said supplying of said lower thread based on the detected one stitch pattern.

16. A sewing machine comprising:

a stitch forming device which forms stitches on a work sheet by locking an upper and a lower thread with each other;

a tension changing device which changes a tension of said lower thread to stop supplying of the lower thread to said stitch forming device at a predetermined timing; and a pattern selecting device which selects one of a plurality of different stitch patterns, said tension changing device stopping said supplying of said lower thread at said predetermined timing, when said pattern selecting device selects a first stitch pattern of said plurality of stitch patterns, and permitting said supplying of the lower thread at said predetermined timing, when said pattern selecting device selects a second stitch pattern of said different stitch patterns.

17. A sewing machine according to claim 16, wherein said second stitch pattern includes stitches formed by laterally swinging a sewing needle with respect to a direction of feeding of said work sheet, and said first stitch pattern consists of stitches which do not include any stitches formed by laterally swinging the needle.

18. A sewing machine according to claim 16, wherein said pattern selecting device comprises a designating device which is operable by a user for designating one of said stitch patterns.

19. A sewing machine according to claim 16, wherein said pattern selecting device comprises a first movable member which is movable to one of a plurality of different positions thereof which corresponds to said one stitch pattern selected thereby, and said tension changing device comprises a second movable member which is movable to one of a plurality of different positions thereof which corresponds to the selected one stitch pattern, the sewing machine further comprising a connecting device which is connected to said first and second movable members to convert the movement of said first movable member to said one position thereof, to the movement of said second movable member to said one position thereof.

20. A sewing machine according to claim 16, further comprising a detecting device which detects said one stitch pattern selected by said pattern selecting device, said tension changing device stopping and permitting said supplying of said lower thread based on the detected one stitch pattern.

* * * * *